US008100551B2

(12) United States Patent
Mayfield, III et al.

(10) Patent No.: US 8,100,551 B2
(45) Date of Patent: Jan. 24, 2012

(54) REPLACEMENT LIGHT FIXTURE AND LENS ASSEMBLY FOR SAME

(75) Inventors: John T. Mayfield, III, Loganville, GA (US); Carl T. Gould, Boulder, CO (US); George McIlwraith, Peachtree City, GA (US); Christopher L. Sharp, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 12/637,051

(22) Filed: Dec. 14, 2009

(65) Prior Publication Data

US 2010/0091484 A1 Apr. 15, 2010

Related U.S. Application Data

(63) Continuation of application No. 11/706,467, filed on Feb. 12, 2007, now Pat. No. 7,635,198, and a continuation-in-part of application No. 10/970,615, filed on Oct. 21, 2004, now Pat. No. 7,229,192, and a continuation-in-part of application No. 10/970,625, filed on Oct. 21, 2004, now Pat. No. 7,261,435.

(60) Provisional application No. 60/860,671, filed on Nov. 22, 2006, provisional application No. 60/722,231, filed on Sep. 30, 2005, provisional application No. 60/580,996, filed on Jun. 18, 2004.

(51) Int. Cl.
*F21S 4/00* (2006.01)

(52) U.S. Cl. ..... 362/223; 362/225; 362/221; 362/285; 362/374; 362/364; 362/220

(58) Field of Classification Search ..... 362/220, 362/221, 223, 364, 225, 287, 285, 374, 375
See application file for complete search history.

(56) References Cited

U.S. PATENT DOCUMENTS

| | | | | |
|---|---|---|---|---|
| 5,823,663 | A * | 10/1998 | Bell et al. | 362/362 |
| 7,229,192 | B2 * | 6/2007 | Mayfield et al. | 362/223 |
| 7,261,435 | B2 * | 8/2007 | Gould et al. | 362/223 |
| 7,635,198 | B2 * | 12/2009 | Mayfield et al. | 362/220 |

* cited by examiner

*Primary Examiner* — Anabel Ton
(74) *Attorney, Agent, or Firm* — Ballard Spahr LLP

(57) ABSTRACT

A replacement light fixture for directing light emitted from a light source toward an area to be illuminated, including a base member upon with the light source is positioned and a reflector assembly detachably secured to a first and second mounting brackets that are mounted to a portion of the preexisting light fixture housing such that a lens portion of the reflector assembly overlies the light source and such that substantially all of the light emitted from the light source passes through the lens portion.

20 Claims, 25 Drawing Sheets

REPLACEMENT LIGHT FIXTURE AND LENS ASSEMBLY FOR SAME

This application is a continuation of U.S. Utility patent application Ser. No. 11/706,467, filed on Feb. 12, 2007, now U.S. Pat. No. 7,635,198, issued Dec. 22, 2009, which claims priority to U.S. Provisional Application Nos. 60/722,231, filed on Sep. 30, 2005, and 60/860,671, filed on Nov. 22, 2006, and is a continuation-in-part of U.S. Utility patent application Ser. No. 10/970,615, filed on Oct. 21, 2004, now U.S. Pat. No. 7,229,192, issued Jun. 12, 2007, and U.S. Utility patent application Ser. No. 10/970,625, filed on Oct. 21, 2004, now U.S. Pat. No. 7,261,435, issued Aug. 28, 2007, which claims priority to U.S. Provisional Application No. 60/580,996, filed on Jun. 18, 2004, all of which are incorporated in their entirety in this document by reference.

FIELD OF THE INVENTION

The present invention generally relates to light fixtures for illuminating architectural spaces. The invention has particular application in light fixtures using fluorescent lamps, such as the T5 linear fluorescent lamp, as the light source. More particularly, the invention relates to a replacement light fixture and a method of retrofitting preexisting recessed light fixtures.

BACKGROUND ART

Numerous light fixtures for architectural lighting applications are known. In the case of fixtures that provide direct lighting, the source of illumination may be visible in its entirety through an output aperture of the light fixture or shielded by elements such as parabolic baffles or lenses. A light fixture presently used in a typical office environment comprises a troffer with at least one fluorescent lamp and a lens having prismatic elements for distributing the light. Also known are light fixtures that use parabolic reflectors to provide a desired light distribution. The choice of light fixture will depend on the objectives of the lighting designer for a particular application and the economic resources available. To meet his or her design objectives, the lighting designer, when choosing a light fixture, will normally consider a variety of factors including aesthetic appearance, desired light distribution characteristics, efficiency, lumen package, maintenance and sources of brightness that can detract from visual comfort and productivity.

An important factor in the design of light fixtures for a particular application is the light source. The fluorescent lamp has long been the light source of choice among lighting designers in many commercial applications, particularly for indoor office lighting. For many years the most common fluorescent lamps for use in indoor lighting have been the linear T8 (1 inch diameter) and the T12 (1.5 inch diameter). More recently, however, smaller diameter fluorescent lamps have become available, which provide a high lumen output from a comparatively small lamp envelope. An example is the linear T5 (⅝ inch diameter) lamp manufactured by Osram/Sylvania and others. The T5 has a number of advantages over the T8 and T12, including the design of light fixtures that provide a high lumen output with fewer lamps, which reduces lamp disposal requirements and has the potential for reducing overall costs. The smaller-diameter T5 lamps also permit the design of smaller light fixtures. The newer technology lamps allow for the design of light fixtures that produce equivalent illumination with only a fraction of the number of lamps that would have been used in a conventional light fixture using older technology lamps.

Some conventional fluorescent lamps, however, have the significant drawback in that the lamp surface is bright when compared to a lamp of larger diameter. For example, a conventional T5 lamp can have a surface brightness in the range of 5,000 to 8,000 footlamberts (FL), whereas the surface brightness of the larger T8 and T12 lamps generally is about 3,000 FL and 2,000 FL, respectively (although there are some versions of linear T8 and T12 lamps with higher brightness). The consequence of such bright surfaces is quite severe in applications where the lamps may be viewed directly. Without adequate shielding, fixtures employing such lamps are very uncomfortable and produce direct and reflected glare that impairs the comfort of the lighting environment. Heretofore, opaque shielding has been devised to cover or substantially surround a fluorescent lamp to mitigate problems associated with light sources of high surface brightness; however, such shielding defeats the advantages of a fluorescent lamp in regions of distribution where the lamp's surfaces are not directly viewed or do not set up reflected glare patterns. Thus, with conventional shielding designs, the distribution efficiencies and high lumen output advantages of the fluorescent lamp can be substantially lost.

A further disadvantage to traditional parabolic and prismatic troffers is the presence of distracting dynamic changes in brightness level and pattern as seen by a moving observer in the architectural space. Additionally, traditional parabolic and prismatic troffers allow direct or only slightly obscured views of the lamp source(s)) at certain viewing angles (low angles for both the parabolic and prismatic and most transverse angle for prismatic). This unaesthetic condition is remedied by indirect and direct-indirect fixture designs, but typically with a significant loss of efficiency.

Another known solution to the problem of direct glare associated with the use of high brightness fluorescent lamps is the use of biax lamps in direct-indirect light fixtures. This approach uses high brightness lamps only for the uplight component of the light fixture while using T8 lamps with less bright surfaces for the light fixtures down-light component. However, such design approaches have the drawback that the extra lamps impair the designer's ability to achieve a desired light distribution from a given physical envelope and impose added burdens on lamp maintenance providers who must stock and handle two different types of lamps.

Conventional parabolic light fixture designs have several negative features. One of these is reduced lighting efficiency. Another is the so-called "cave effect," where the upper portions of walls in the illuminated area are dark. In addition, the light distribution of these fixtures often creates a defined line on the walls between the higher lit and less lit areas. This creates the perception of a ceiling that is lower than it actually is. Further, when viewed directly at high viewing angles, a conventional parabolic fixture can appear very dim or, even, off.

The present invention overcomes the above-described disadvantages of light fixtures using brighter light sources by providing a configuration that appears to a viewer as though it has a source of lower brightness, but which otherwise permits the light fixture to advantageously and efficiently distribute light generated by the selected lamp, such as the exemplified T5 lamp. The light fixture of the present invention reduces distracting direct glare associated with high brightness light sources used in direct or direct-indirect light fixtures. This reduction in glare is accomplished without the addition of lamps and the added costs associated therewith.

As discussed above, recent developments in lamp technologies have resulted in higher efficiency, brighter lamps with better color rendering. Particularly, these developments have resulted in the availability of new technology lamps and light fixtures with the performance describe above. Commercial clients desire the ability to more efficiently and effectively illuminate their work or display environments by utilizing the newer technology lamps and light fixtures. However, the newer technology lamps cannot be installed into existing fixtures as they require different lamp holders and ballasts.

Replacement of existing fixtures is very costly. This option requires the purchase of completely new fixtures, wiring and construction costs of removing the old fixtures and installing the new fixtures, as well as the additional burden of the inconvenience and cost of closing down sections of the commercial structure as the construction proceeds.

The present invention particularly addresses the cost and convenience issued involved with newer technology lamps, sockets, and ballasts. The present invention also allows installation of a newer technology light fixture without disturbing the ceiling or the plenum area above the ceiling, which eliminates potential environmental concerns, such as asbestos contamination and the cost of asbestos removal, that can be associated with disturbing the ceiling or plenum.

SUMMARY OF THE INVENTION

The present invention relates to a replacement or retrofit light fixture, or troffer, for efficiently distributing light emitted by a light source into an area to be illuminated. The lens and reflector of the present invention increase the light efficiency of the replacement or retrofit light fixture and diffuses the light relatively uniformly, which minimizes the "cave effect" commonly noted in areas using conventional parabolic light fixtures in the ceiling.

In one embodiment, suitable for retrofit or replacement applications, the present invention relates to a downlight light fixture for efficiently distributing light emitted by a light source into an area to be illuminated that can be mounted in a preexisting light fixture housing, which can be, in one aspect, conventionally mounted therein a ceiling.

In one exemplary embodiment, the retrofit light fixture of the present application can comprise a longitudinally extending base member that is configured to mount therein a preexisting recessed light fixture housing mounted in and above a ceiling plane. The retrofit light fixture can also comprise a first mounting bracket and an opposed second mounting bracket. In one aspect, each mounting bracket can be configured for mounting to an edge portion of a respective end wall of the light fixture housing. In a further aspect, the base member is hingeably connected to the first mounting bracket such that the base member can be move about and between an installation position, in which the base member is suspended from the first mounting bracket, and an operating position, in which the base member is selectively secured to the first and second mounting brackets.

In a further aspect, the retrofit light fixture can further comprise a longitudinally extending reflector assembly that comprises at least one elongated lens. In one aspect, the reflector assembly is constructed and arranged to be detachably secured to a lower portion of the first and second mounting brackets such that the reflector assembly is positioned at or above the ceiling plane of the ceiling and underlies the base member of the base assembly. In this aspect, it is contemplated that the reflector assembly and the lens can be, in one example, formed integral to each other. In a further aspect, it is contemplated that the lens is positioned with respect to a portions of the reflector assembly to receive light emitted by the light source and distribute it such that glare is further reduced. In a preferred embodiment, the lens of this exemplary retrofit light fixture receives and distributes substantially all of the light emitted by the light source.

In an additional aspect, the base member is configured to receive at least one light source that is releasably mounted to electrical lamp sockets, which are connected to portions of the base member. In one example, a ballast is mounted to a top surface of the base member such that the ballast is hidden from view of an external observer when the base member is mounted to the preexisting housing. In one aspect, a movable access door is provided that can be opened and closed by an operator to access a ballast that is disposed in an interior cavity that is formed between the top surface of the base housing and portions of the preexisting housing. In another aspect, the ballast can be mounted to a portion of the top surface of the movable access door for ready access to the ballast by an operator.

Related methods of operation are also provided. Other systems, methods, features, and advantages of the replacement or retrofit light fixture for distributing generated light will be or become apparent to one with skill in the art upon examination of the following figures and detailed description. It is intended that all such additional systems, methods, features, and advantages be included within this description, be within the scope of the replacement or retrofit light fixture for distributing generated light, and be protected by the accompanying claims.

BRIEF DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION OF THE INVENTION

Figure 1:
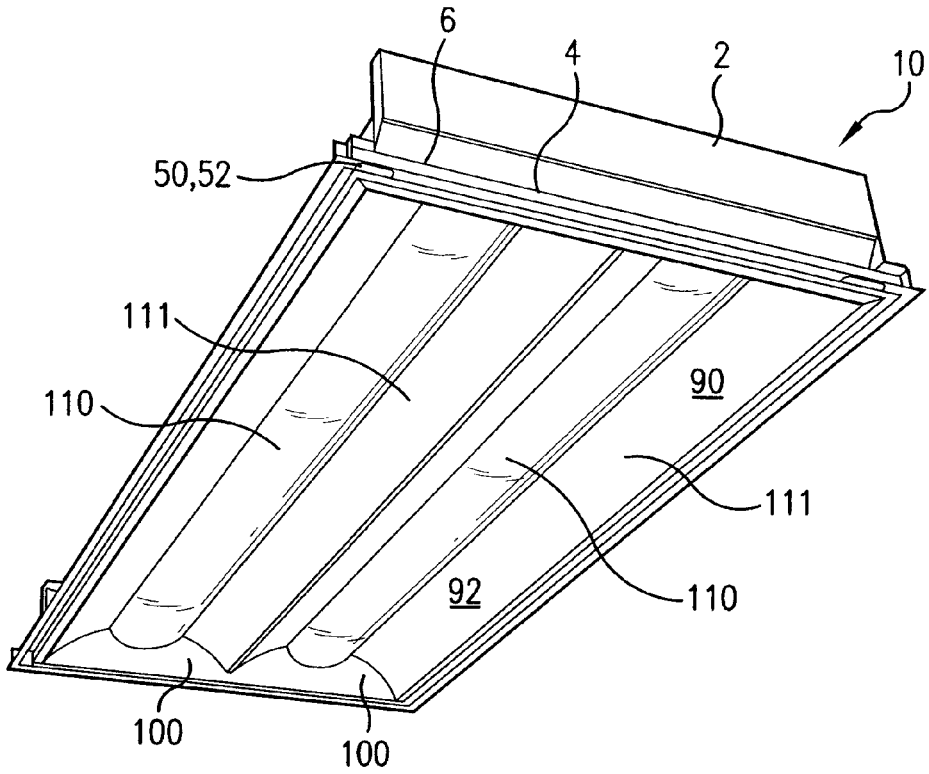
FIG. 1 is perspective view of one embodiment of the retrofit light fixture of the present invention mounted therein a preexisting light fixture housing.
Figure 2:
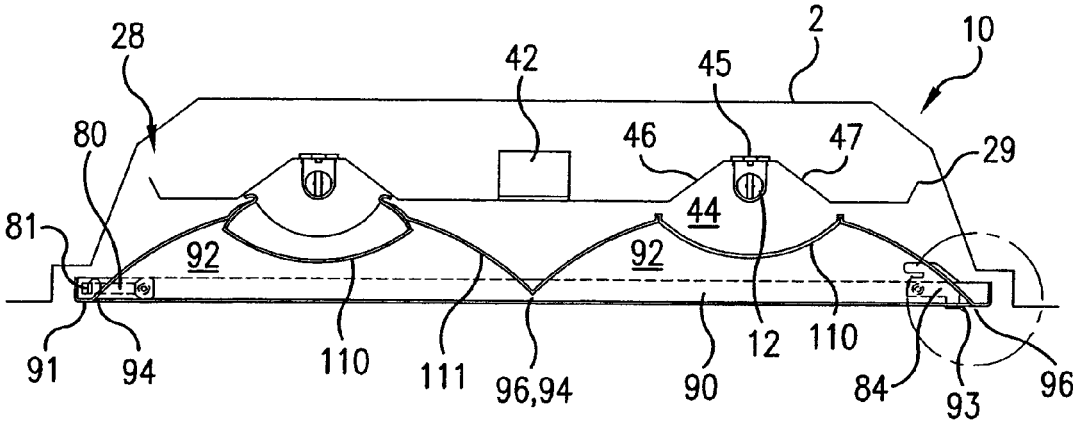
FIG. 2 is a cross sectional view of one embodiment of the retrofit light fixture of the present invention, showing two exemplary lens/reflector embodiments. On the left is shown an exemplary reflector assembly comprises a vacuum formed reflector and a preformed lens that is connected to a cut out center section of the vacuum formed reflector. On the right is shown a reflector assembly having a lens that is integrally formed with the reflector assembly via a conventional injection molding process.
Figure 3:
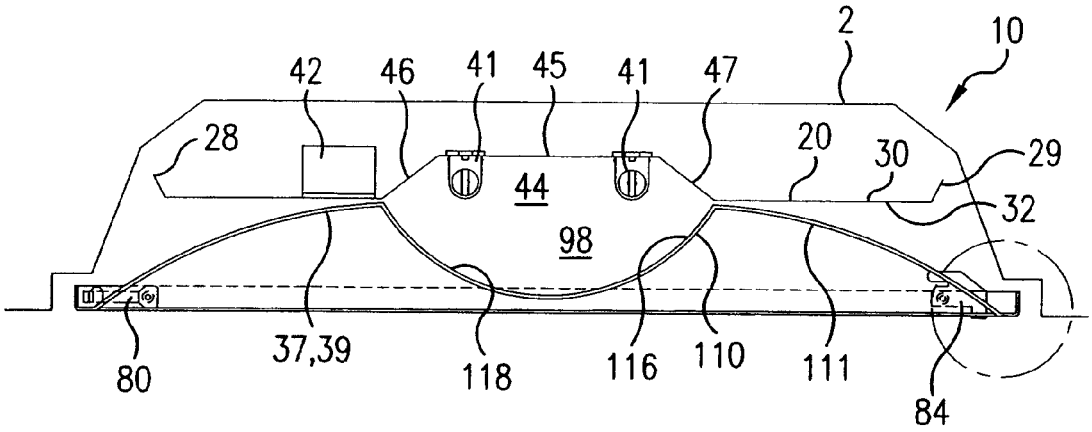
FIG. 3 is a cross sectional view of one embodiment of the retrofit light fixture of the present invention mounted therein a preexisting light fixture housing.
Figure 4:
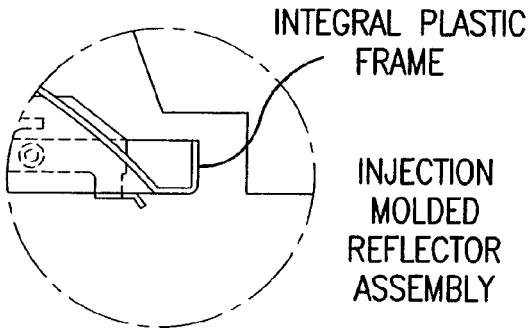
FIG. 4 is an enlarged sectional view of an exemplary embodiment of a reflector assembly, showing corner detail of the reflector assembly formed via an injection molding process.
Figure 5:
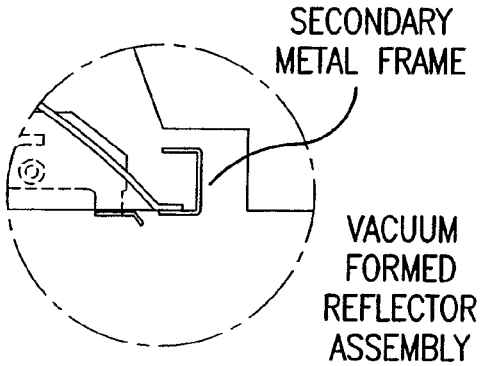
FIG. 5 is an enlarged sectional view of an exemplary embodiment of a reflector assembly, showing corner detail of the reflector assembly formed via a vacuum forming process, and showing a secondary metal frame that surrounds the peripheral edge of the reflector assembly.
Figure 6A:
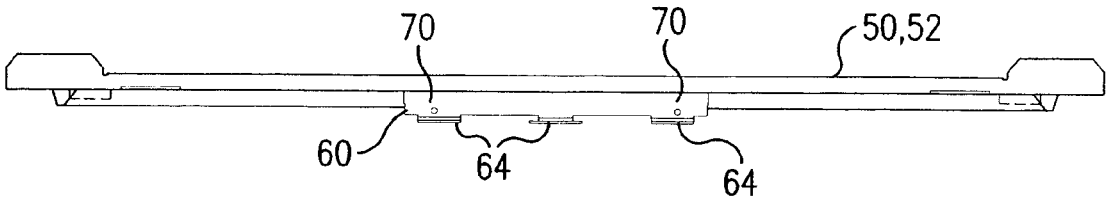
FIGS. 6A-6C are elevational views of an exemplary embodiment of a mounting bracket of the present invention.
Figure 6B:
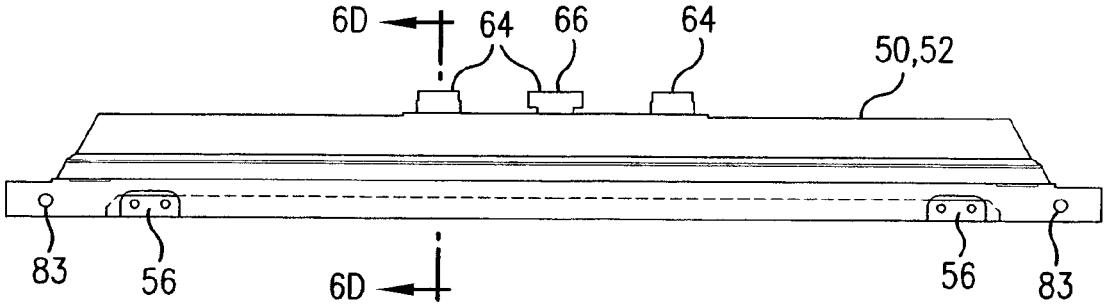
Figure 6C:
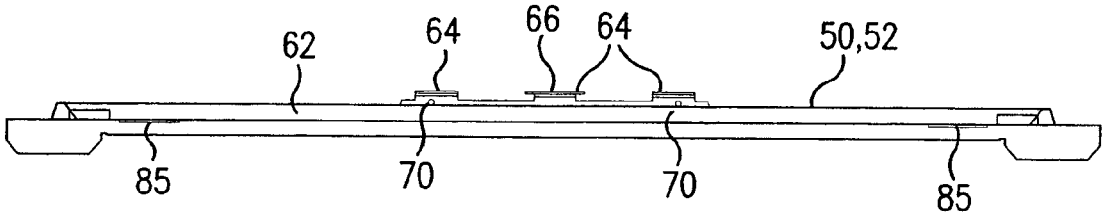
Figure 6D:
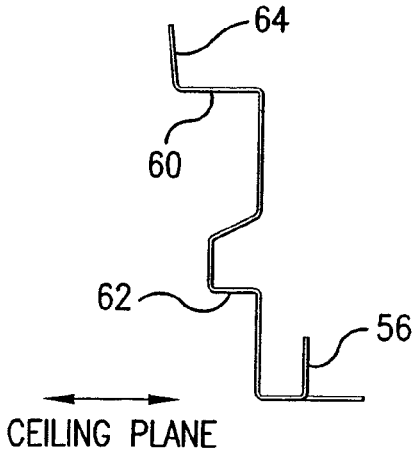
FIG. 6D is a cross-sectional view of the mounting bracket of FIG. 6B taken along line 6D-6D.
Figure 7A:
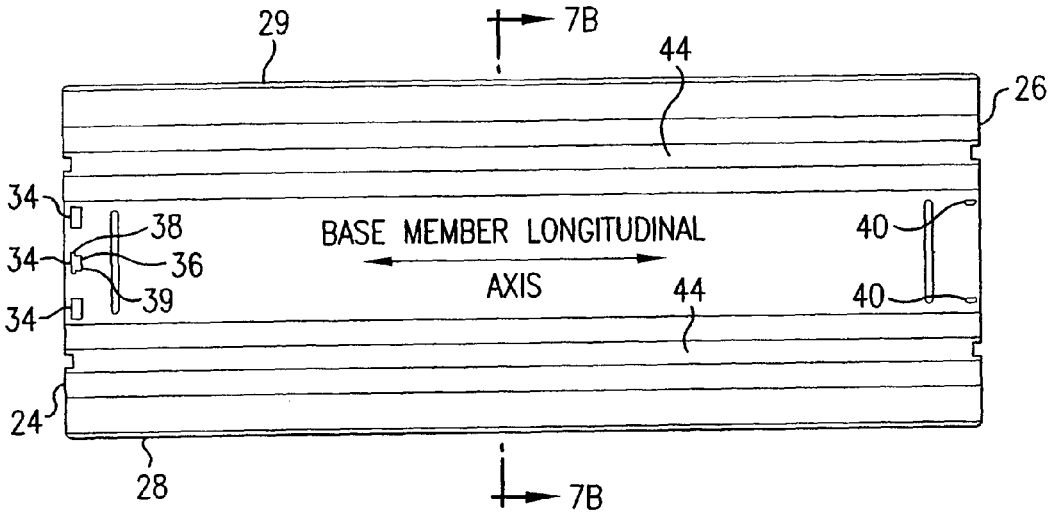
FIG. 7A is a bottom elevational view of an embodiment of a base member of a base assembly of the retrofit light fixture of the present invention.
Figure 7B:
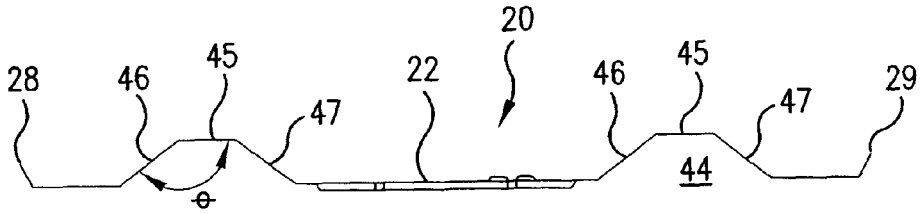
FIG. 7B is a cross-sectional view of the base member of FIG. 7A taken along line 7B-7B.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "surface" includes aspects having two or more such surfaces unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

Referring to FIGS. 1-14, in one embodiment of the present invention, a retrofit light fixture 10 of the present invention for illuminating an area includes a base assembly 20 for housing a linear light source 12, a first mounting bracket 50, a second mounting bracket 52, and a reflector assembly 90. In one aspect, the light source extends along a light longitudinal axis between a first end 14 and a spaced second end 16. Light emanating from the light source 12 is diffused by the reflector assembly 90 that is positioned between the light source 12 and the area to be illuminated. The light source 12 may be a conventional fluorescent lamp, such as, for example and not meant to be limiting, a conventional T5 lamp.

The base assembly 20 of the retrofit light fixture includes an elongated base member 22 that has a proximal edge 24, a spaced distal edge 26, a first longitudinally extending side edge 28 and an opposed second longitudinally extending side edge 29. The base member 22 extends along a base member longitudinal axis and has a top surface 30 and a bottom surface 32. It is contemplated that the base member can be formed from a single piece of material or from a plurality of adjoined pieces. As one will appreciate, the base member can be formed from any code-compliant material. For example, the base member can be formed from steel.

In one aspect, the base member defines at least one slot 34 and at least one aperture 40. In one aspect, the at least one slot is defined adjacent the proximal edge 24 of the base member and the at least one aperture 40 is defined adjacent the opposed distal edge 26 of the base member. It is contemplated that the at least one slot can comprise a plurality of slots. Similarly, it is contemplated that the at least one aperture can comprise a plurality of apertures. In one exemplary aspect, the aperture can be substantially circular is shape. Alternatively, the aperture 40 can be elongated in at least one axis. For example, the aperture can have an elongated axis that extends substantially parallel to the longitudinal axis of the base member.

In another aspect, at least one of the slots defined in the base member can form a mounting slot 36 that has a top portion 38 and a bottom portion 39. In one aspect, the top portion of the mounting slot can be positioned adjacent the proximal edge of the base member and has a first dimensional width $w_1$ substantially transverse to the longitudinal axis of the base member. The bottom portion 39 of the mounting slot has a second dimensional width $w_2$ substantially transverse to the longitudinal axis of the base member that is less than the first dimensional width. In one exemplary aspect, the mounting slot 36 can have a substantially T shape. It is contemplated that one or more of the slots of the base member 22 can be formed as a mounting slot. In a further aspect, it is also contemplated that two or more of the slots can have a similar size and shape.

The base assembly 20 can also comprise a plurality of lamp sockets 41 that are selectively mounted to the base member. As one skilled in the art will appreciate, a pair of opposed lamp sockets can be configured and positioned on the base member for each elongated linear lamp source that is to be used in the retrofit light fixture. In a further aspect, the base assembly 20 can comprise a ballast 42 that is electrically coupled to the lamp sockets. In one example, the ballast 42 is mounted to a top surface 30 of the base member such that the ballast is hidden from view of an external observer when the base member is mounted to the preexisting light fixture housing 2. In another aspect, a ballast opening (not shown) can be defined in the base member and a movable access door cab be provided that is configured to be opened and closed by an operator to selectively cover the ballast opening. This allows the operator to access a ballast that is disposed in an interior cavity that is formed between the top surface of the base housing and portions of the preexisting light fixture housing. In another aspect, the ballast 42 can be mounted to a portion of the top surface of the movable access door for ready access to the ballast by the operator.

The base member 22 can also define at least one longitudinally extending trough 44 that extends upwardly away from the respective side edges 28, 29 of the base member. In one aspect, each trough 44 comprises a top surface 45, a first side trough surface 46 and an opposed second side trough surface 47. In another aspect, at least one pair of opposing lamp sockets can be mounted on the top surface 45 of each trough for receiving the elongated light source 12. In one aspect, at the trough 44 extends along an axis parallel to the longitudinal axis of the base member. In one exemplary aspect, and not meant to be limiting, the lamps sockets can be positioned adjacent the respective proximal and distal edges 24, 26 of the base member 22.

Each respective first and second side trough surfaces defines a trough surface axis that extends in a vertical plane normal to the base member longitudinal axis of the base member. In one aspect, the trough surface axis of each of the first and second trough surfaces 46, 47 respectively forms an angle $\theta$ of about and between about 140° to 90° with respect to the top surface 45 of the trough. More particularly, the angle $\theta$ can be about and between about 135° to 95° with respect to the top surface of the trough. Still more particularly, the angle $\theta$ can be about and between about 130° to 100° with respect to the top surface 45 of the trough. In another aspect, the angle $\theta$ formed between each of the respective first and second trough surfaces and the top surface of the trough can be substantially equal.

Referring now to FIGS. 6A-6D, each mounting bracket 50, 52 is configured for mounting to an edge portion 4 of a respective end wall 6 of the preexisting light fixture housing 2. In one aspect, a lower portion 54 of the mounting bracket can define a channel 56 that is configured to be slidably received onto the edge portion 4 of the respective end wall of the preexisting light fixture housing. In one aspect, it is contemplated that the channel is configured for a friction fit with a portion of the respective end wall of the preexisting light fixture housing. Holes 56 can be defined in the lower portion of each mounting bracket so that each mounting bracket can be secured to its respective end wall by use of a conventional mechanical fastener, such as, for example, a self tapping screw, bolt, or the like. In one aspect, it is contemplated that each of the respective first and second mounting brackets can be substantially centered on the respective end walls of the preexisting light fixture housing.

In a further aspect, each mounting bracket has an upper shoulder surface 60 and a medial shoulder surface 62 that is configured to receive the reflector assembly. In one aspect, the upper and medial shoulder surfaces extend substantially parallel to the ceiling plane. In another aspect, at least the first mounting bracket 50 can have at least one male tab protrusion 64 that extends upwardly away from the upper shoulder surface 60 that is configured to selectively cooperate with the at least one slot 34 of the base member 22. In one aspect, the at least one male tab can be substantially centered relative to the elongated dimension of the upper shoulder surface of the first mounting bracket. It is contemplated that the at least one male tab protrusion 64 can comprise a plurality of male tab protrusions that are configured to selectively cooperate a complementary plurality of slots 34 of the base member.

In another aspect, at least one of the male tab protrusions 64 extending from the upper shoulder surface of the first mounting member can form a mounting male tab protrusion 66 that has a distal end dimensional width $w_d$ that is greater than the dimensional width of a proximal end portion $w_p$ that is connected to the upper shoulder surface 60. In one exemplary aspect, the mounting male tab protrusion 64 can have a substantially T shape. It is contemplated that one or more of the male tab protrusions of the first mounting bracket can be formed as a mounting male tab protrusion. In a further aspect, it is also contemplated that two or more of the male tab protrusions can have a similar size and shape. As one skilled in the art will appreciate, the interconnection of the complementary mounting slot and mounting male tab protrusion can allow for a secure connection between the base member and the first mounting bracket that also allows for pivotal movement of the base member 22 relative to and above the first mounting bracket 50 and the preexisting light fixture housing 2.

In one aspect, when mounted thereto the preexisting light fixture housing 2, each male tab protrusion 64 can extend upwardly at an acute angle $\alpha$ with respect to a plane parallel to the ceiling plane. In one aspect, the acute angle $\alpha$ is about and between about 70° to 90° with respect to the plane parallel to the ceiling plane. More particularly, the angle $\alpha$ can be about and between about 80° to 90° with respect to the plane parallel to the ceiling plane. Still more particularly, the angle $\alpha$ can be about 85° with respect to the plane parallel to the ceiling plane.

In one aspect, the base assembly 20 is movable between an installation position, in which the base member 22 is suspended from the first mounting bracket 50 by the cooperative engagement of the at least one male tab protrusion of the first mounting bracket and the at least one slot of the base member, and an operating position, in which the base member 22 is selectively secured to the first and second mounting brackets 50, 52 by the cooperative engagement of the at least one tab of the first mounting bracket and the at least one slot of the base member and the connection of the upper shoulder surface of the second mounting bracket to a top surface of the base member. In a further aspect, holes 70 can be defined in the upper shoulder surface of the mounting bracket. In operation, the apertures 40 defined in the base member 22 are substantially axially aligned with the holes 70 in the upper shoulder surface so that the upper shoulder surface of the second mounting bracket can 20 be secured to the top surface of the base member via use of a conventional mechanical fastener, such as, for example, a self tapping screw, bolt, or the like.

It is contemplated that the first and second mounting brackets 50, 52 can have different shapes. However, for ease of installation and for minimizing production costs, it is preferred that the first and second mounting brackets can have substantially similar shapes.

Referring now to FIGS. 4, 5, 8A-9, the longitudinally extending reflector assembly 90 is configured to be detachable secured to a portion of the first and second mounting brackets. In one aspect, when it is secured to the respective first and second mounting brackets, the reflector assembly is positioned at or above the ceiling plane. In another aspect, the reflector assembly has a first longitudinally extending side edge 91 and an opposed second longitudinally extending side edge 93. In a further aspect, the reflector assembly can be selectively positioned thereto the first and second mounting brackets such that the respective longitudinal extending side edges of the reflector assembly are substantially parallel to or co-planar with the ceiling plane.

The reflector assembly 90 further comprises at least one elongated lens 110. In one aspect, each lens extends longitudinally substantially parallel to or co-axial with the longitudinal axis of the reflector assembly. In a further aspect, each lens can be positioned with respect to a respective trough of the base member such that substantially all of the light generated or emitted by the light fixture passes through the at least one lens 110.

In one aspect, the elongated lens can be replaceably connected to the reflector assembly. Optionally, the elongated lens can be formed integrally with the reflector assembly. In another embodiment, the lens can be separately formed and can then be permanently connected to the reflector assembly to form an integral body. In various aspects, and as shown in the figures, it is contemplated that the reflector assembly can be formed by a conventional vacuum forming process, a conventional injection molding process, or other conventional processes as known to one skilled in the art. In one exemplary aspect, the center portion of the hollow can be cut away and configured to accept a preformed lens, which can be removably mounted or fixedly mounted as desired. In one further aspect, it is contemplated that the lenses can be substantially light transmissive and the reflector portions can be opaque. In a further aspect, the co-molded lens can include micro optic patters that negate the need for the use of a diffusing overlay.

As outlined above, it is contemplated that the reflector and lens can be, in one example, formed integral to each other or can, in another example, be separate pieces that can be mounted with respect to each other and the base housing. In one aspect, the reflector portion of the reflector assembly is substantially opaque. In another aspect, the reflectors can have, as described below, a corrugated surface.

In a further aspect, a reveal can be provided between at least one edge of the replacement light fixture and the preexisting light fixture housing such that airflow is allowed when the replacement light fixture is installed as a replacement for an air handling light fixture. In yet another aspect, the reflector assembly can be configured to overlap the T-grid at the respective ends of the replacement light fixture only.

In a further aspect, a portion of the reflector assembly 90 forms at least one longitudinally extending hollow 92 that extends inwardly in the transverse dimension away from the respective first and second longitudinally extending side edges of the 91, 93 reflector assembly. Each hollow 92 has a first hollow edge 94 and a second hollow edge 96. Each hollow extends inwardly to a central portion 98 between the respective first and second hollow edges 94, 96. In one aspect, the lens 110 is positioned in the central portion of the defined hollow. In one respect, at least a portion of each hollow 92 preferably forms a reflective surface 95 extending between central portion 98 and a respective one of the first and second hollow edges 94, 96. In one embodiment, at least a portion of a section of each hollow 92 normal to the base member longitudinal axis has a generally curved shape such that such that portions of the hollow 92 form a generally curved reflective surface 95 for diffusely reflecting light received from the lens into the architectural space in a desired pattern. In one embodiment, the transverse section of the hollow can have a conventional barrel shape. In an alternative embodiment, a portion of each hollow 92 can have at least one planar portion. In one aspect of the invention, the light source 12 can be positioned between the bottom surface of the base member and an inner surface of the lens.

In one aspect, at least a portion of the hollow of the base member can be painted or coated with a reflective material or formed from a reflective material. The reflective material may be substantially glossy or substantially flat. In one example, the reflective material is preferably matte white to diffusely reflect incident light.

The central portion 98 of the light fixture is preferably symmetrically positioned with respect to the first and second hollow edges 94, 96. The retrofit light fixture 10 of the present invention can include one or more hollows 92 that each houses a light source 12. For example, in a light fixture having a hollow, the first and second hollow edges 94, 96 of the hollow would extend generally to the respective longitudinally extending side edges of the reflector assembly. In an alternative example, in which the light fixture 10 has two hollows, the reflector assembly 90 defines a pair of adjoining, parallel hollows 92.

In one aspect, at least a portion of the hollow(s) 92 of the reflector assembly 90 has a plurality of male ridges 37 formed thereon that extend longitudinally between the ends of the base member. In an alternative aspect, at least a portion of the hollow(s) of the base member has a plurality of female grooves 39 formed thereon that extend longitudinally between the ends of the base member. Optionally, the ridges or grooves extend at an angle to the longitudinal axis of the base member. For example, the male ridges or female grooves may extend transverse to the base member longitudinal axis (i.e., extending between the respective first and second longitudinally extending side edges 91, 93 of the reflector assembly). The ridges or grooves formed on the hollow provide a diffusely reflecting surface.

Figure 13:
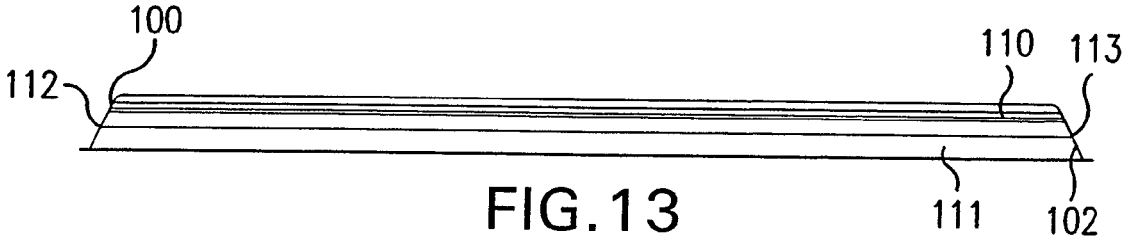
FIG. 13 is a cross-sectional view of one embodiment of a reflector housing of the reflector housing showing a pair of opposing angled end faces.
Figure 12:
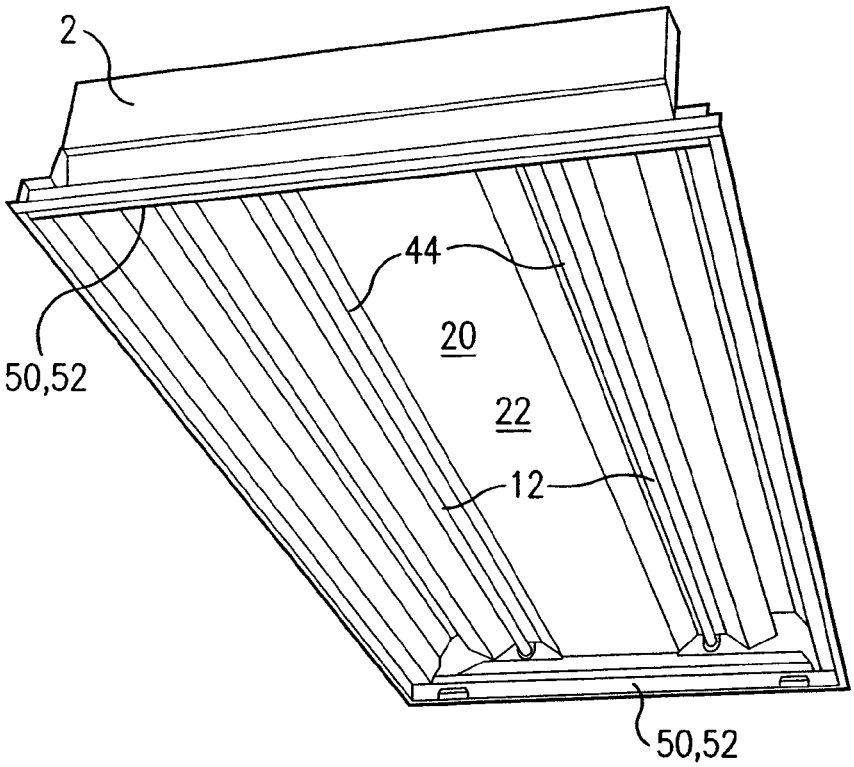
FIG. 12 is a bottom perspective view of the base assembly rotated up and mechanically connected to the mounting bracket that is positioned opposite the hingedly connected mounting bracket.
Figure 14:
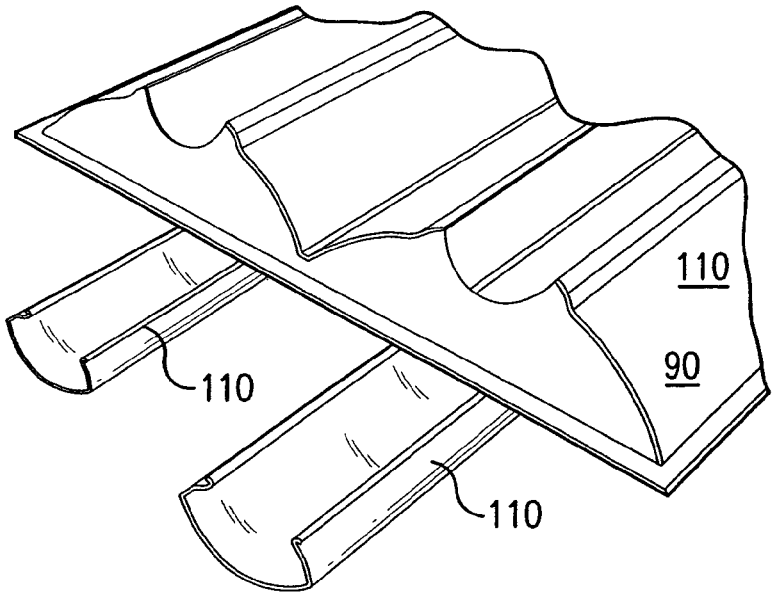
FIG. 14 is a partial exploded view of one exemplary embodiment of the reflector assembly showing two preformed lens being coupled to respective center portions of the hollows of the reflector assembly.
Figure 15:
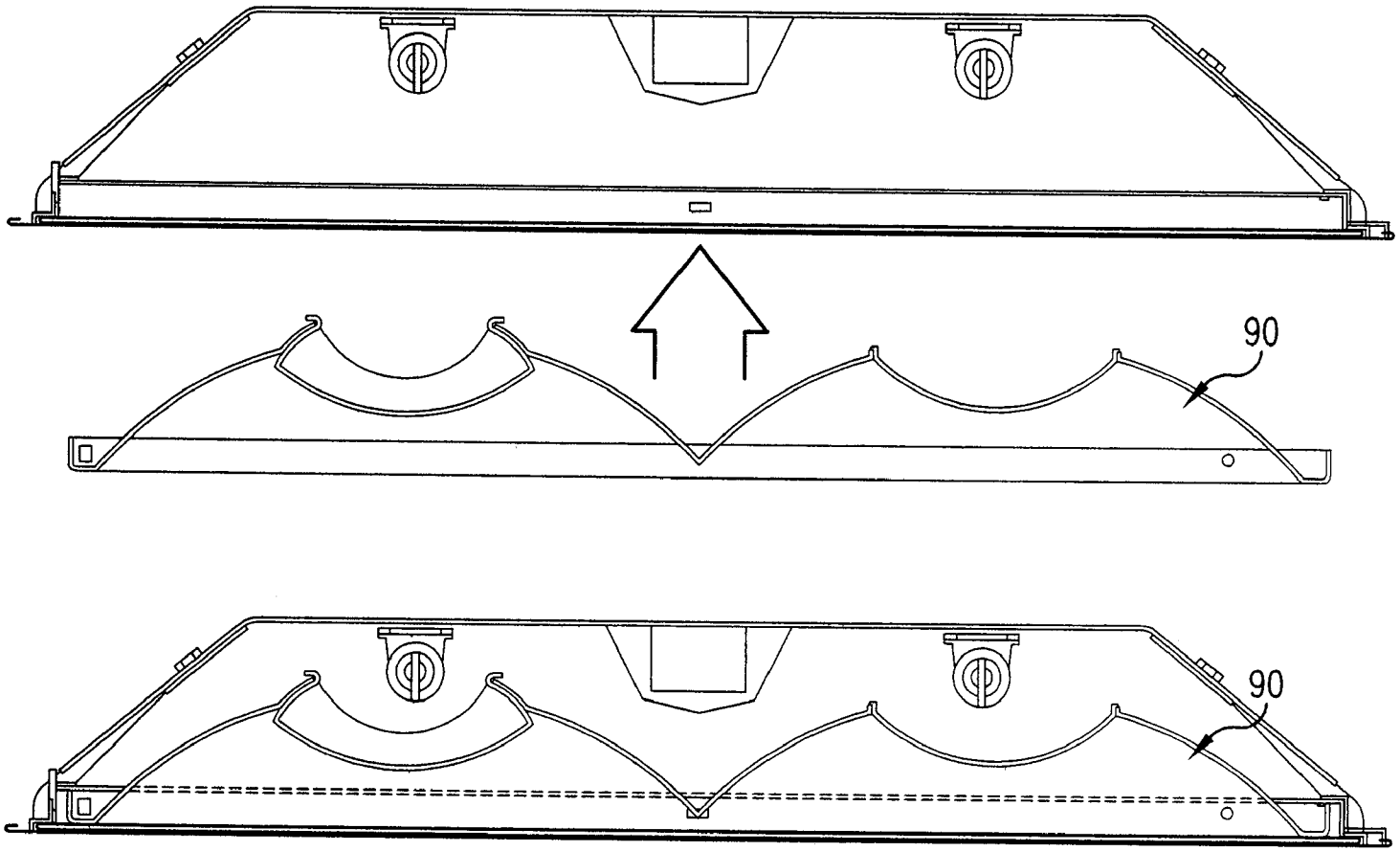
FIG. 15 are cross sectional views of one embodiment of the retrofit light fixture of the present invention, showing the reflector assembly being inserted therein a preexisting light fixture without removing the preexisting lamps and ballast. Similar to FIG. 2 above, two exemplary lens/reflector embodiments on illustrated in the same figure for illustration purposes. On the left is shown an exemplary reflector assembly that can comprise a vacuum formed reflector and a preformed lens that is connected to a cut out center section of the vacuum formed reflector. On the right is shown a reflector assembly that has an integrally formed lens, which is exemplarily formed via a conventional injection molding process.
Figure 16:
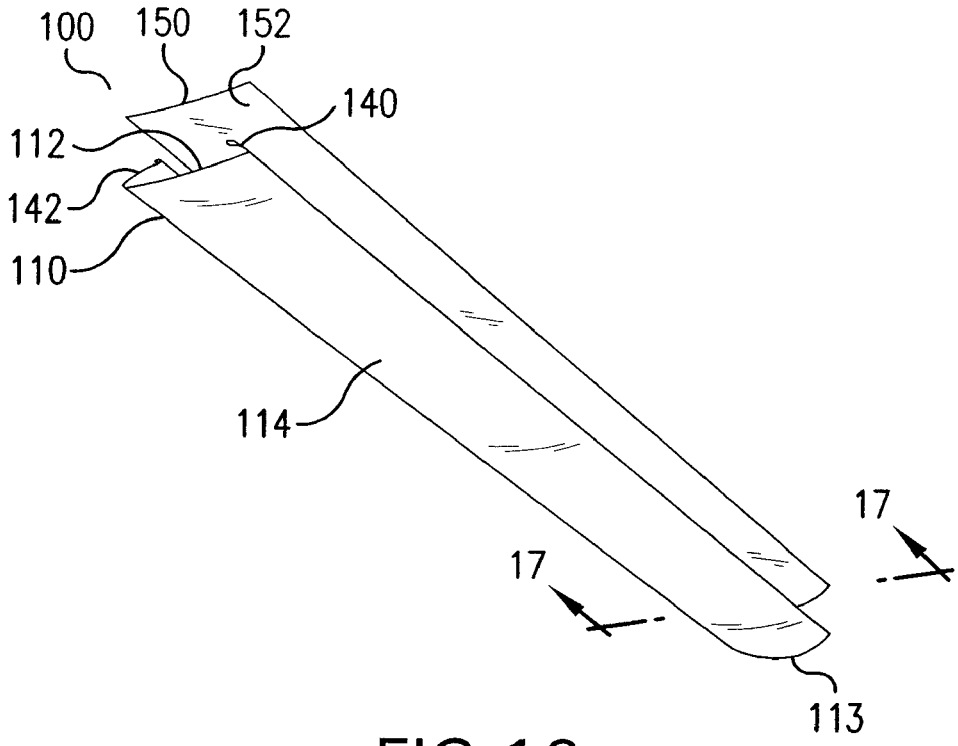
FIG. 16 is an exploded top perspective view of one embodiment of a lens assembly of the light fixture of the present invention showing an elongated lens and a diffuser inlay.
Figure 17:
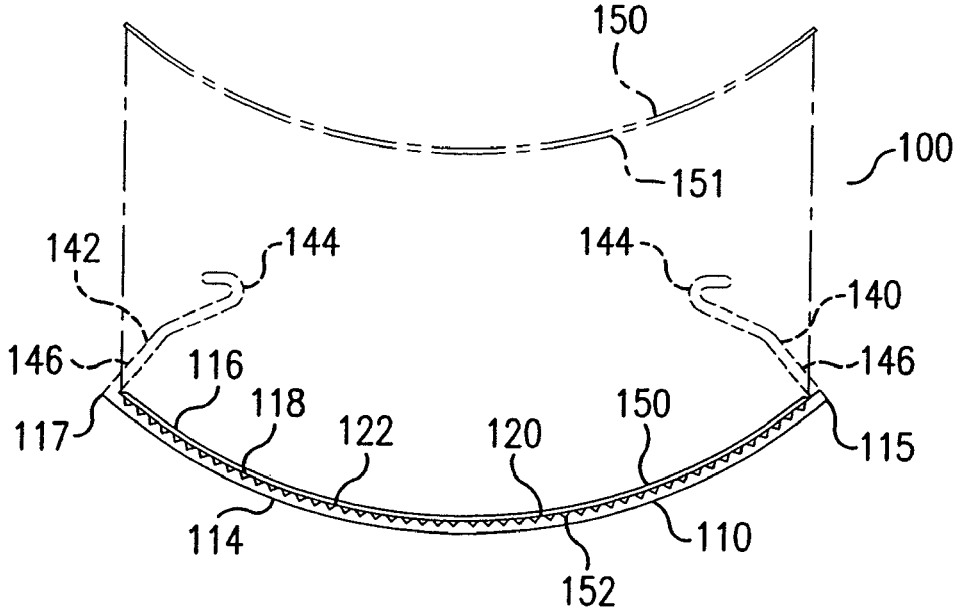
FIG. 17 is a cross-sectional view of the lens assembly of FIG. 16, taken along line 17-17.
Figure 18:
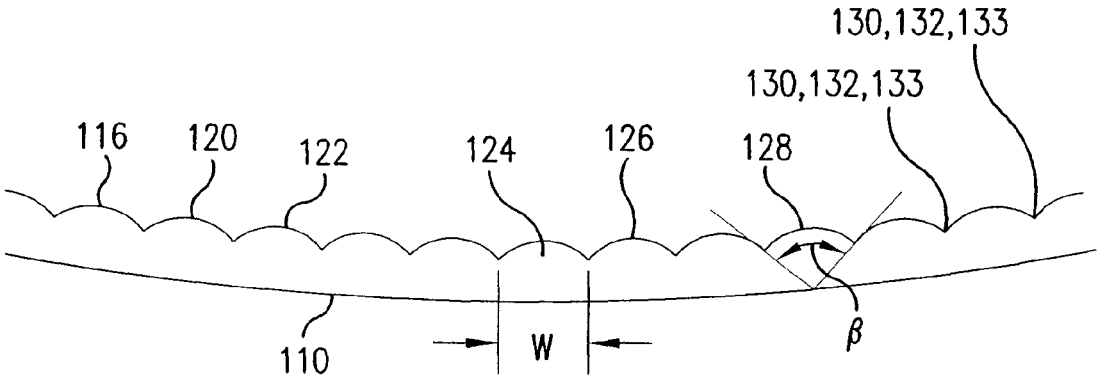
FIG. 18 is an enlarged partial cross-sectional view of a lens, showing one embodiment of an array of prismatic elements disposed on a surface of the lens.
Figure 19:
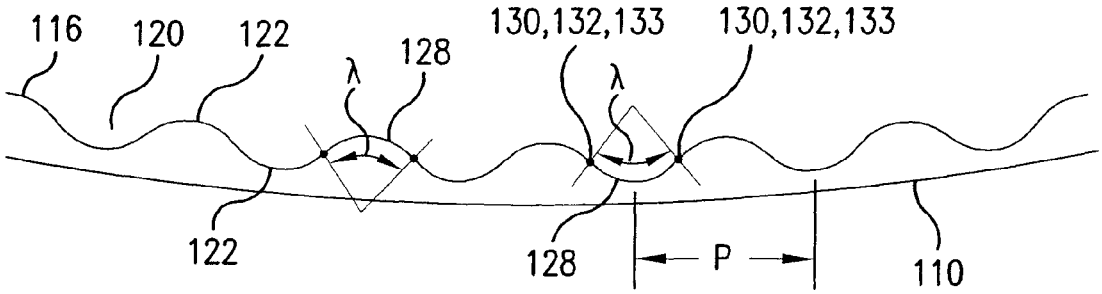
FIG. 19 is an enlarged partial cross-sectional view of a lens, showing an alternative embodiment of the array of prismatic elements.
Figure 20:
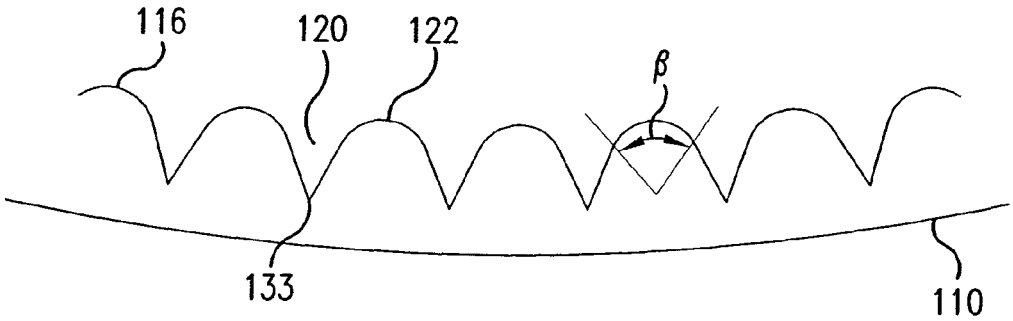
FIGS. 20 and 21 are enlarged partial cross-sectional views of a lens, showing still further alternative embodiments of the array of prismatic elements.
Figure 21:
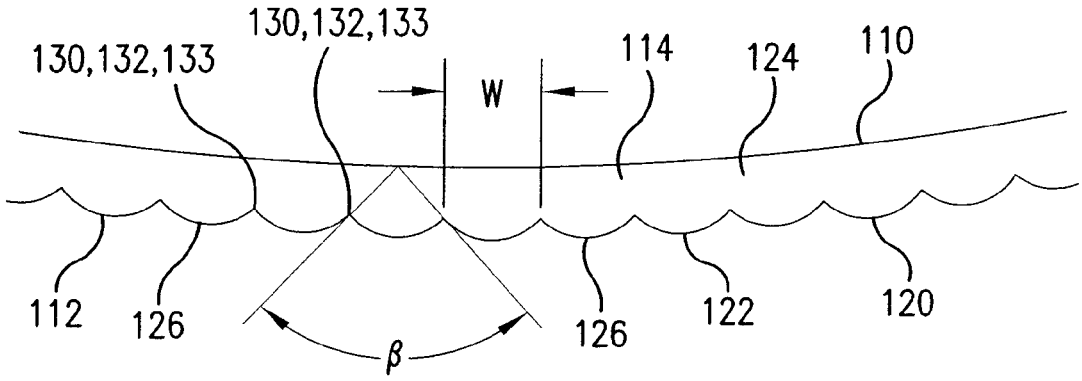
Figure 22:
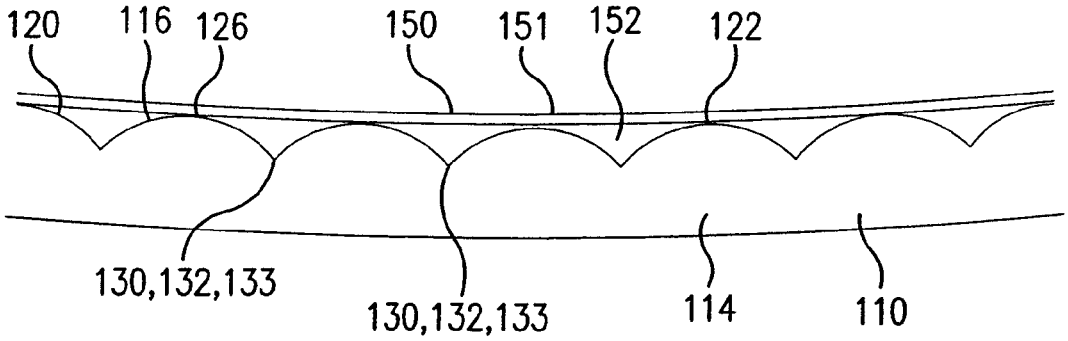
FIG. 22 shows an enlarged partial cross-sectional view of one embodiment of the lens of the present invention with a diffuser inlay in registration with a portion of the prismatic surface of the lens.

As shown in FIG. 13, the reflector assembly 90 can also include a first end face 100 and an opposed second end face 102. Each of the end faces extends upwardly from a respective bottom end edge other reflector assembly to respective ends edges 112, 113 of the lens. Each end face has a face longitudinal axis that forms an obtuse angle with respect to the longitudinal axis of the reflector assembly 90. The angled first and second end faces 100, 102 optically alter the apparent perspective of the light fixture and aesthetically give the light fixture a deeper appearance.

In one aspect, the face longitudinal axis of each of the first and second end faces 100, 102 respectively forms an angle Ω of about and between 95° to 160° with respect to the longitudinal axis of the reflector assembly. More particularly, the face longitudinal axis of each of the first and second end faces respectively forms an angle Ω of about and between 100° to 150° with respect to the longitudinal axis of the reflector assembly. Still more particularly, the face longitudinal axis of each of the first and second end faces respectively forms an angle Ω of about and between 100° to 135° with respect to the longitudinal axis of the reflector assembly. In another aspect, the face longitudinal axis of each of the first and second end faces respectively forms an angle Ω of about 120° with respect to the longitudinal axis of the reflector assembly. In yet another aspect, the respective obtuse angles formed between the face longitudinal axis of the first end face 50 and the face longitudinal axis of the second end face 52 and the longitudinal axis of the reflector assembly are substantially equal.

Alternative shapes of the first and second end faces 100, 102 are contemplated. Each of the first and second end faces may be substantially planar or non-planar. In the non-planar embodiments, portions of the first and second end faces are curved. The curved portions of the first and second end faces can be substantially concave or substantially convex. Portions of the first and second end faces can also have male ridges or female grooves formed thereon. The male ridges or female grooves can be sized, shaped and oriented to visually complement the male ridges or female grooves 39 on the hollows or the reflector assembly, as described above.

Figure 8A:
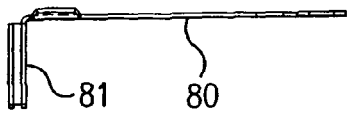
FIGS. 8A-8B are elevational views of an exemplary embodiment of a hinge bias member that is configured to be coupled to an edge of a reflector assembly of the present invention.
Figure 8B:
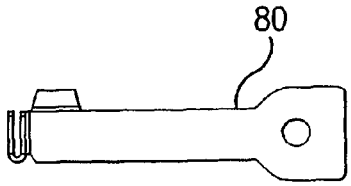
Figure 9:
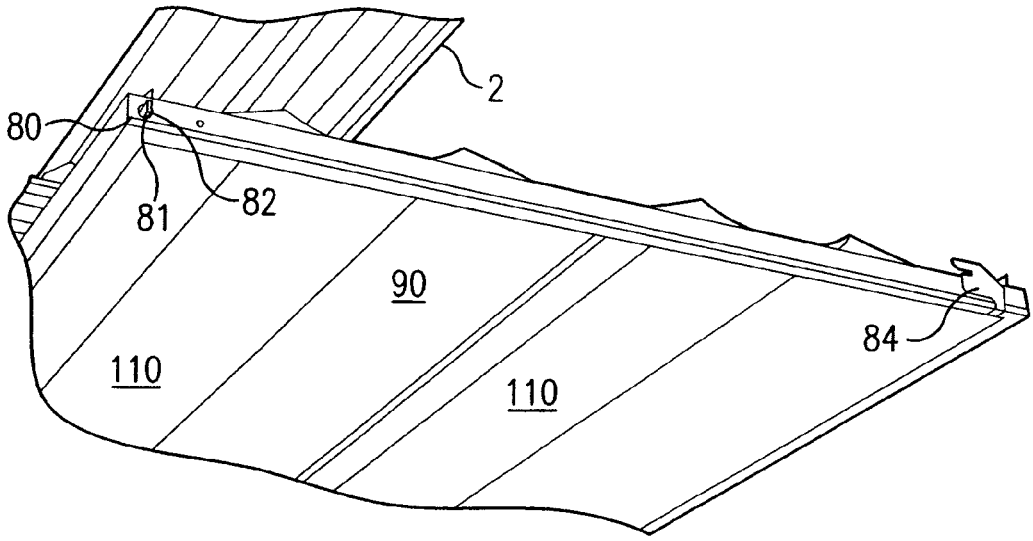
FIG. 9 is an enlarged partial perspective view of the end edge detail of an exemplary reflector assembly, showing a latch and a spring hinge bias member.
Figure 10:
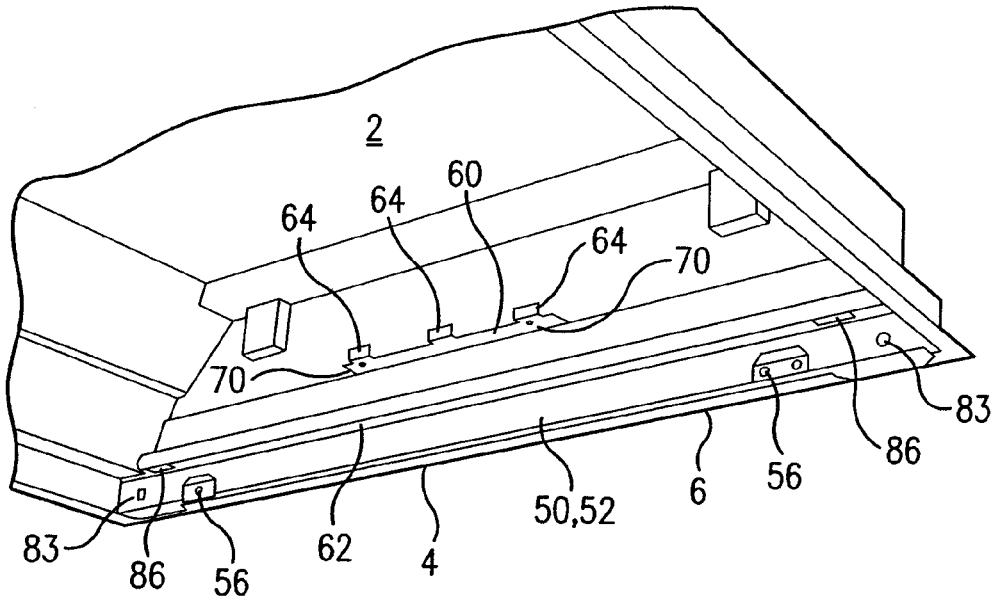
FIG. 10 is a partial perspective view of one embodiment of a mounting bracket of the present invention coupled to an edge portion of an end wall of the preexisting light fixture housing.

The retrofit light fixture 10 of the present invention also can comprise means for selectively pivotably securing the reflector assembly to the first and second mounting brackets. In one aspect, a plurality of bias members 80 and a plurality of latches 84 are provided that allow for the hinging motion of the reflector assembly 90 relative to the first and second mounting brackets 50, 52, and hence the preexisting light fixture housing 2, and the selective securing of the reflector assembly to the first and second mounting brackets. Referring to FIGS. 8-10, an exemplified bias member and a rotatable latch are illustrated. It will be appreciated by one skilled in the art that conventional spring members and latches can be used in the present application.

In one exemplary aspect, a bore 82 is defined in each peripheral end edge of the reflector assembly 90 that can be positioned substantially co-axial to complementary openings 83 that are defined in the lower portion of both the first and the second mounting brackets 50, 52. In this aspect, an arm 81 of the bias member 80, which is operatively coupled to an interior portion of the end edge of the reflector assembly, is configured to selectively engage each aligned bore and openings. In another exemplary aspect, each latch 84 is pivotably mounted to each peripheral end edge of the reflector assembly 90 and is configured to selectively, by rotation by the installer, engage a latch slot 85 that is defined in the lower portion of each mounting bracket 50, 52.

It will be appreciated that the opening in the mounting brackets can comprise a pair of openings that are positioned adjacent the opposing ends of the mounting brackets 50 that the installer can selectively determine, based on the space and environmental concerns in the work space, from which side of the respective mounting bracket it is desired to have the reflector assembly hinged to. In this aspect, the latch slot can comprise a pair of latch slots that are symmetrically positioned about the center of the respective mounting bracket.

In one aspect, in operation, portions of each of the first and second end faces 100, 102 can be positioned in overlying registration with at least a portion of a selected end of the light source 12. The brighter conventional lamps, such as the exemplified T5 lamp, are typically shorter and have an elongated dark portion proximate its ends when compared to other conventional elongated fluorescent lamps, such as, for example, conventional T8 and T12 lamps. Thus, in use, the end faces can prevent the darkened ends of the selected light source from being visible through the lens assembly.

The lens 110 of the present invention is constructed and arranged to direct light emitted by the light source 12 onto the area to be illuminated. A basic function of the lens 110 is to diffuse the light from the light source 12 to effectively reduce the brightness of the light source 12 so that it is substantially hidden from view. Thus, one function of the lens assembly is to effectively become the source of light for the light fixture. This is accomplished in the preferred embodiment by providing the lens 110 with a plurality of longitudinally extending prismatic elements with short focal lengths. Because of the short focal lengths of the prismatic elements, the light from the light source is focused to parallel images very close to the surface of the lens at large angles of convergence. Because of the large angles of convergence, the images overlap and the light is essentially diffused. The diffused light is then either directed onto the surface to be illuminated without further reflection or is reflected by the reflective surfaces of the hollow 95. Thus, the lens provides a diffuse source of lowered brightness.

In one aspect, the lens can be placed higher in the retrofit light fixture and provides geometric control of high-angle rays emanating from the lens in the transverse direction. Thus, light rays produced at high viewing angles are physically blocked by the bottom longitudinally extending side edges of the reflector assembly, which prevents glare at high angles in that transverse direction. The retrofit light fixture of the invention can, in an optional aspect, control glare in the longitudinal direction optically.

As discussed and illustrated in applicants' co-pending U.S. patent application Ser. Nos. 10/970,615 and 10/970,625, the disclosures of which are incorporated herein in their entireties by this reference, high angle glare is reduced in the retrofit light fixture of the present invention. Thus, in this aspect, the retrofit light fixture of the invention prevents glare at high viewing angles through two mechanisms, geometrically in the transverse direction and optically in the longitudinal direction.

In one aspect, the lens 110 comprises a first end edge 112 and an opposed second end edge 113. The lens has a lens longitudinal axis that extends between the first and second end edges. In one example, the lens longitudinal axis is generally parallel to the light longitudinal axis of the light source 12. In use, substantially all of the light emitted by the light source 12 passes through the lens 110 prior to impacting portions of the reflective surfaces 95 of the reflector assembly and/or prior to being dispersed into the surrounding area.

The lens 110 can be made from any suitable, code-compliant material such as, for example, a polymer or plastic. For example, the lens 110 can be constructed by extruding pellets of meth-acrylate or polycarbonates into the desired shape of the lens. The lens 110 can be a clear material or translucent material. In another aspect, the lens can be colored or tinted. It is contemplated that the reflector portion 111 of the reflector assembly as well as the lens can be substantially formed from plastic or polymer materials for both significant cost and weight savings. In one aspect, the lens provides structural support for a plastic and/or polymeric reflector portion such that the reflector assembly is self supporting and does not necessarily require the use of metal supports, such as, for example, a peripherally extending metal frame.

At least a portion of the lens has a prismatic surface 116 on a face 118 of the lens that is either spaced from and facing toward the light source 12 or, alternatively, spaced from and facing away from the light source 12. In one aspect of the invention, the lens is curved in cross-section such that at least a portion of the face 118 of the lens has a concave or convex shape relative to the light source. In an alternative embodiment, at least a portion of the lens is planar in cross-section.

In one aspect, the lens 110 is positioned within the reflector assembly so that it is recessed above a substantially horizontal plane extending between the first and second longitudinally extending side edges of the reflector assembly. In a further aspect, the lens is recessed within the reflector assembly such that a plane bisecting one of the respective first and second longitudinally extending side edges of the preexisting light fixture housing or, optionally, of the reflector assembly, and a tangential portion of the lens is oriented at an acute angle γ to the generally horizontal plane extending between the selected first and second longitudinally extending side edges. In one aspect, the acute angle γ is about and between 3° to 30°. More particularly, the acute angle γ is about and between 05° to 20°. Still more particularly, the acute angle γ is about and between 10° to 15°.

The recessed position of the lens within the reflector assembly provides for high angle control of light emitted by the retrofit light fixture in a vertical plane normal to the longitudinal axis of the reflector assembly. In use, an observer approaching the ceiling mounted retrofit light fixture 10 of the present invention from the side (i.e., from a direction transverse to the longitudinal axis of the reflector assembly) would not see the lens until they passed into the lower viewing angles. In effect, portions of the reflector assembly act to block the view of the lens from an observer at the higher viewing angles (i.e., the viewing angles closer to the horizontal ceiling plane).

In one aspect, as shown in FIGS. 18-21, the prismatic surface 116 of the lens defines an array of linearly extending prismatic elements 120. In one example, each prismatic element 122 thereof can extend substantially longitudinally between the first and second edge edges 112, 113 of the lens. Alternatively, each prismatic element 122 thereof can extend linearly at an angle relative to the lens longitudinal axis. For example, each prismatic element thereof can extend generally transverse to the lens longitudinal axis. In a further aspect, each prismatic element 122 can have substantially the same shape or, alternatively, can vary in shape to effect differing visual effects on an external observer, lighting of the hollow surface, or light distribution to the room. In one aspect, each prismatic element has a portion that is rounded or has a curved surface.

In one aspect, in section normal to the lens longitudinal axis, each prismatic element has a base 124 and a rounded apex 126. Each prismatic element extends toward the apex 126 substantially perpendicular with respect to a tangent plane that extends through the base 124. In one aspect, an arcuate section or curved surface 128, normal to the lens longitudinal axis, of each prismatic element 122 subtends an angle β of about and between 85° to 130° with reference to the center of curvature of the arcuate section. More particularly, the arcuate section 128 of each prismatic element forms an angle β of about and between 90° to 120°. Still more particularly, the arcuate section 128 forms an angle β of about and between 95° to 110°. In another aspect, the arcuate section 128 forms an angle β of about 100°.

In one aspect, the arcuate section 128 extends from a first cusp edge 130 of the prismatic element 122 to an opposed second cusp edge 132. In this example, adjoining prismatic elements are integrally connected at a common cusp edge 130, 132, 133. Alternatively, the arcuate section 128 may be formed in a portion of the apex 126 of the prismatic element 122, such that adjoining prismatic element are integrally connected at a common edge 133. In this example, portions of the prismatic element 122 extending between the arcuate section and the common edge 133 can be planar or non-planer, as desired. It should be understood that other configurations and shapes are contemplated where the cross section of the optical elements is not strictly circular, and includes, for example, parabolic, linear, or other shapes.

In one aspect, the base 124 of each prismatic element 122 has a width (w) between its respective common edges of about and between 0.5 inches to 0.01 inches. More particularly, the base of each prismatic element has a width between its respective common edges of about and between 0.3 inches to 0.03 inches. Still more particularly, the base of each prismatic element has a width between its respective common edges of about and between 0.15 inches to 0.05 inches.

In another aspect, a section of the array of prismatic elements 120 can have a shape of a continuous wave. The section can be normal to the lens longitudinal axis. In one aspect, the shape of the continuous wave is a periodic waveform that has an arcuate section 128 formed in both the positive and negative amplitude portions of the periodic waveform (i.e., two prismatic elements are formed from each periodic waveform). The period of the periodic waveform can be substantially constant or may vary along the array of prismatic elements. In one aspect, the periodic waveform is a substantially sinusoidal waveform. In this example, the common cusp "edge" 130,132 between the two prismatic elements 122 forming from each periodic waveform occurs at the transition from positive/negative amplitude to negative/positive amplitude.

In one aspect, the arcuate section 128 of each prismatic element 122 within each of the positive and negative amplitude portions of the periodic waveform subtends an angle λ, of about and between 85° to 130° with reference to a center of curvature of the arcuate section. More particularly, the arcuate section 128 of each prismatic element within each of the positive and negative amplitude portions of the periodic waveform forms an angle λ of about and between 90° to 120°. Still more particularly, the arcuate section 128 of each prismatic element within each of the positive and negative amplitude portions of the periodic waveform forms an angle λ, of about and between 95° to 110° with respect to the base member longitudinal axis. In another aspect, the arcuate sections 128 within each of the positive and negative amplitude portions of the periodic waveform form an angle λ of about 100°.

In one aspect, the period P of each prismatic element is about and between 1.0 inches to 0.02 inches. More particularly, the period P of each prismatic element is about and between 0.6 inches to 0.06 inches. Still more particularly, the period P of each prismatic element is about and between 0.30 inches to 0.10 inches.

It is contemplated that the lens 110 of the reflector assembly 100 can be constructed and arranged for detachable connection to the reflector assembly of the light fixture 10. Optionally, the lens of the reflector assembly can be integrally formed with the reflector assembly. In one aspect, when positioned relative to the base member 22, the lens of the reflector assembly can extend generally parallel to the light longitudinal axis and generally symmetric about a plane that extends through the light longitudinal axis. In one other aspect, the plane of symmetry extends through the area desired to be illuminated.

In a further aspect, the reflector assembly can further comprise a conventional diffuser inlay 150, such as, for example, a OptiGrafix™ film product, which is a diffuser film that can be purchased from Grafix® Plastics. The diffuser inlay 150 can be pliable or fixed in shape, transparent, semi-translucent, translucent, and/or colored or tinted. In one example, the diffuser inlay 150 has relatively high transmission efficiency while also scattering a relatively high amount of incident light to angles that are nearly parallel to its surface. In one aspect, the diffuser inlay is positioned between a portion of the face 118 of the lens and the light source 12. In another aspect, the diffuser inlay is configured for positioning in substantial overlying registration with the portion of the face 118 of the lens that is oriented toward the light source 12.

In a further aspect, the diffuser inlay 150 may be positioned in substantial overlying registration with a portion of the prismatic surface 116 of the lens. In one aspect of the present invention, there is a gap 152 formed between portions of the two adjoining rounded prismatic elements 120 extending between the respective apexes of the two adjoined prismatic elements and the bottom face 151 of the diffuser inlay 150. The formed gap can enhance the total internal refection capabilities of the lens 110.

The lens 110 and reflector assembly 20 of the present invention increases the light efficiency of the light fixture 10 and diffuses the light relatively uniformly so that the "cave effect" commonly noted in areas using conventional parabolic light fixtures in the ceiling are minimized. In one embodiment, the light fixture 10 or troffer of the present invention results in a luminare efficiency that is greater than about 80%, preferably greater than about 85%. The efficiency of the light fixture 10 measured by using a goniophotometer to compare the light energy from the light fixture at a given angle with the light from an unshielded light source, as specified in the application testing standard. The retrofit light fixture 10 of the present invention has reduced light control relative to conventional parabolic fixtures to provide a lit space (particularly the walls) with a bright appearance while still maintaining adequate control and comfortable viewing for today's office environment.

In one embodiment, the lens 110 has a concave face 118 oriented toward the light source 12 when the lens 110 is secured to and within a portion of the reflector assembly 20. In one aspect, the array of male rounded prismatic elements 120 can be extruded along the length of the lens 110. In use, the lens of the present invention design has a striped visual characteristic to an external observer when back lit. These "stripes" provide for visual interest in the lens 110 and may be sized and shaped to mirror any ridges or grooves disposed therein portions of the reflective surfaces 33 of the hollow 32 of the reflector assembly 20. The "stripes" also help to mitigate the appearance of the image of the lamp (the light source) by providing strong linear boundaries that breakup and distract from the edges of the lamp against the less luminous trough 40 of the reflector assembly 20. In addition, the "stripes" allow for the retrofit light fixture 10 of the present invention to provide high angle light control in vertical planes that are substantially parallel to the longitudinal axis of the light fixture.

In a preferred embodiment, a primary function of the lens is to optically reduce the brightness of the light source. In addition, the lens reduces the brightness of the light source even further at higher viewing angles in the longitudinal direction by the optical phenomenon of total internal reflection. This allows the efficient use of light sources of higher brightness while nevertheless reducing glare at high viewing angles.

It will be appreciated that the retrofit light fixture of the invention utilizes a unique combination of features to reduce high-angle glare in the transverse and longitudinal directions. In the transverse direction, high angle glare is controlled primarily by the geometric relationship between the lamp and the reflector assembly of the retrofit light fixture, while in the longitudinal direction, high angle glare is controlled primarily by the lens optically. In the preferred embodiment, the lens itself essentially becomes the light source, which effectively reduces lamp brightness in both the transverse and longitudinal directions optically, to further reduce glare associated with lamps of high brightness.

One skilled in the art will appreciate that a "reverse ray," "backward ray" or "vision ray" is a light ray that originates from a hypothetical external viewer's eye and is then traced through the optical system of the light fixture. Although there is no physical equivalent, it is a useful construct in predicting how a particular optical element will look to an observer. In the present invention, on at least one side at the respective common cusp edges of adjoining rounded prismatic elements, there exists a sufficiently large angle of incidence $\omega$ relative to the normal extending from the point of incidence of the reverse ray at the lens to air interface that a reverse ray will undergo total internal reflection. In one aspect, the angle of incidence $\omega$ is at least about 40°. More particularly, the angle of incidence $\omega$ is at least about 45°. Still more particularly, the angle of incidence $\omega$ is at least about 50°. In effect, the array of prismatic elements acts as an array of partial light pipes.

Each rounded prismatic element has a sufficiently large angular extent such that some total internal reflection at each common cusp edge is assured regardless of viewing angle. In one aspect, since each arcuate section of each rounded prismatic element is substantially circular, if a reverse ray undergoes total internal reflection at one portion of the arcuate section and is subsequently reflected to another portion of the arcuate section, then total internal reflection will also occur at the second point of incidence because the arcuate section's geometry causes both interactions to have substantially the same angle of incidence. Generally then, a reverse ray that undergoes total internal reflection proximate a common cusp edge will eventually exit the lens out the same outer surface through which it entered the lens and will terminate on a surface or object in the room (as opposed to passing through the lens and terminating on the light source or the trough of the reflector assembly behind the lens). The reverse ray is said to be "rejected" by the lens. This means that the brightness an external viewer will perceive at the common cusp edge of adjoining rounded prismatic elements is the brightness associated with a room surface because any real/forward light ray impinging on the viewer's eyes from this part of the lens must have originated from the room or space. Generally, the brightness of an object or surface in the room is much lower than that of the light source or trough that is viewed through the central portions of the arcuate sections of each prismatic element. This high contrast in brightness between the common cusp edge between adjoining rounded prismatic elements and the central portion of the arcuate sections of each prismatic element is so high that it is perceived, to the external viewer, as dark stripes on a luminous background.

In another aspect, the linear array of prismatic elements of the lens assembly optically acts in the longitudinal direction to reduce high angle glare. This may be explained by considering a reverse ray that is incident on a portion of the prismatic surface of the lens proximate the common cusp edge at the critical angle (the minimum angle of incidence $\omega$) for total internal reflection of the reverse ray. An observer viewing that portion of the lens (i.e., the portion of the area about the common cusp edge) would perceive it as being "dark" relative to that adjacent "bright" portion of the arcuate section proximate the rounded apex of each individual prismatic element. The array of linear elements thus optically controls the light emitted from the lamp in the longitudinal direction.

In one example, as the lens is viewed at higher and higher viewing angles (as when the observer is further from the light fixture) in a vertical plane parallel or near parallel to the base member longitudinal axis of the base member, the striping effect become more pronounced. This is a result of the increase in that portion of the prismatic surface of the lens that undergoes total internal reflection and creates the dark strips.

This results from viewing the lens at angles greater than the critical angle for total internal reflection of a "reverse ray." Thus, the effective width of each stripe grows as the lens is viewed at higher viewing angles, which is observed as the lens becoming dimmer at higher viewing angles.

In the vertical planes extending between the base member longitudinal axis of the reflector assembly and an axis transverse to the base member longitudinal axis, higher view angle control is achieved through a combination of the high angle control proffered by the linearly extending array of prismatic elements of the lens, as discussed immediately above, and the lens assembly being recessed within the reflector assembly. In the vertical plane substantially parallel to the base member longitudinal axis of the reflector assembly, the optical elements of the lens assembly, i.e., the array of prismatic elements, exert primary glare control of the higher viewing angles. In the vertical plane substantially transverse to the base member longitudinal axis of the reflector assembly, the recessed position of the lens assembly within the reflector assembly exerts primary glare control of the higher viewing angles.

In one aspect, if the prismatic shapes are regularly spaced apart, the striping effect would also be regularly spaced. In another aspect, the prismatic elements of the present invention can be configured as desired to ensure some total internal reflection at all viewing angles so that the "striping" is perceptible at all viewing angles.

In use, normal movement of a viewer in the room does not change the viewer's vertical angle of view relative to the light fixture very rapidly and at far distances the stripes become less distinct. Therefore, the change is stripe width is not perceived as a dynamic motion but rather as a subtle changing of the overall lens brightness (i.e., brighter at low vertical angles and dimmer when viewed at high vertical angles).

The rounded or curved surfaced portions of each prismatic element can provide wide spreading or diffusion of any incident light. The high degree of diffusion helps to obscure the image of the light source as seen through the lens even when the light source is in relatively close proximity to the face of the lens that is oriented toward the light source. This becomes increasingly apparent as the lens is viewed at higher vertical angles in the vertical plane substantially parallel to the light source.

In a further aspect, the rounded or curved surface portions of the prismatic elements provides for a gradual change in the perceived brightness as a result of a change in the angle of view. In yet another aspect, in an embodiment of the invention in which each prismatic element has substantially the same shape, the dark striping and the brighter areas of the lens appear to change uniformly and smoothly from one prismatic element to the next, adjoining prismatic element.

As described above, the present invention relates to a replacement or retrofit light fixture 10, or troffer, for efficiently distributing light emitted by a light source into an area to be illuminated. As described above, the lens 110 and reflector assembly 90 of the retrofit light fixture increases the light efficiency of the replacement or retrofit light fixture and diffuses the light relatively uniformly, which minimizes the "cave effect" commonly noted in areas using conventional parabolic light fixtures in the ceiling. For example, it is estimated that the replacement of a conventional 3 lamp parabolic troffer with a retrofit light fixture 10 of the present invention would result in an annual energy savings of about 170 kWh. For the replacement of a conventional 4 lamp parabolic troffer, the annual energy savings of about 526 kWh is estimated.

Figure 11:
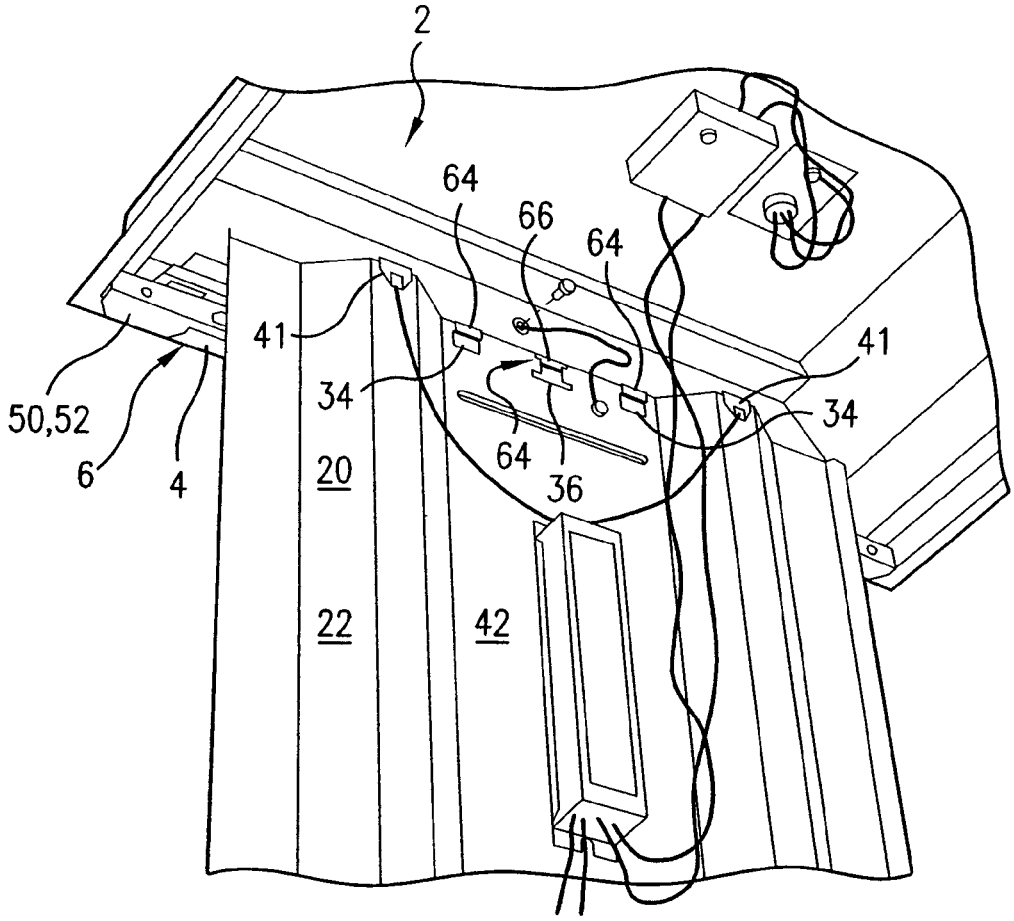
FIG. 11 is a partial perspective view of a base member of a base assembly being hung from the male tab protrusions of the mounting bracket, and showing the respective power leads connecting the lamp sockets and the ballast, the power leads connecting the ballast and the existing power leads of the preexisting light fixture and the respective ground leads operatively coupled. A splice box is also shown coupled to the surface of the preexisting light fixture housing.

In one aspect of the present invention, and as one skilled in the art will appreciate, the design of the base assembly enables attachment of the retrofit ballast and lamp sockets to the base member and the electrical wiring connection between the retrofit ballast and lamp sockets to be performed during a manufacturing process at a factory. Thus, the installer does not have to devote time or labor to these tasks. As further shown in FIG. 11, the retrofit light fixture can also comprise power leads that are configured for connection to the preexisting power leads extending from the preexisting light fixture housing. Further, and as shown in FIG. 11, in compliance with electrical code requirements, the retrofit light fixture can also comprise a ground lead configured to electrically couple the base member to the preexisting light fixture housing and a splice box that is configured to mount to the bottom surface of the preexisting light fixture housing and can operatively accept the power leads extending from the retrofit ballast.

Installation of the exemplary embodiment of the retrofit into the existing fixture is illustrated in FIGS. 10 through 16. One skilled in the art will appreciate that the following steps can be accomplished by a one-man installation crew, which allows for additional cost savings. Exemplary steps are as follows.

First, power must be disconnected to the existing fixture. Then the existing lamps, reflector, ballast of the existing light fixture can be removed, which leaves the existing power leads extending therein the internal cavity of the preexisting light fixture housing exposed. As one will appreciate, these existing power leads are electrically coupled to a conventional remote power source. The next step is to mount the respective first and second mounting brackets to the edge portions of the respective opposing end walls of the preexisting light fixture housing. The mounting brackets can then be mechanically secured to the preexisting light fixture. In one aspect, the mounting brackets are substantially centered on the respective end walls.

The next installation step is to hang the base member from first mounting bracket by it's at least one male tab protrusion. This can be accomplished by inserting the at least one male tab protrusion within it's complementary at one slot of the base member. In one aspect, the mounting male tab protrusion is inserted into the mounting slot of the base member. The base member can be released so that it is supported in the installation position by the first mounting bracket.

The power lines for the ballast of the base assembly can then be coupled to the existing power leads. Optionally, the grounds from the base member to the preexisting light housing can be attached. In a further aspect, a splice box can be mounted to a surface of the preexisting light housing such that a portion of the coupled power leads pass therethough the splice box. After the wiring connections are complete, the installer may then swing the base member up into place so that the at least one aperture of the base member is positioned in substantially overlying registration with the holes 70 that are defined in the upper shoulder surface of the second mounting bracket 52. Subsequently, a portion of the top surface of the base member is mechanically connected to the upper shoulder surface of the second mounting bracket. In a further aspect, if not previously installed, the light source(s) 12 can be mounted to the light sockets that are mounted on the base member.

It will be appreciated, that if the first and second mounting brackets are similarly shaped, the base member would be initially hingeably hung from the respective mounting member that is closest to the existing power lead opening in the preexisting light fixture housing.

Next, the reflector assembly is coupled to the mounting brackets. In one aspect, the installer makes initial decision as to the desired direction for hingeable opening of the reflector assembly. Subsequently, the installer inserts the bias members 80 of the reflector assembly thereto the respective openings 83 that are defined in the lower portion of both the first and second mounting brackets. In one exemplary aspect, and as shown in FIGS. 8A and 8B, the arm 81 of the bias member has a substantially cross-sectional rectangular shape and the respective opening has a substantially circular shape so that the arm will tend to self-center its self when it is inserted into the opening 83. The reflector assembly is then rotated about the formed hinge to seat against the medial shoulder surface of the mounting brackets and the latch of the reflector assembly is rotated to engage the latch slot 85 in the lower portion of each mounting bracket 50, 52 to selectively secure the reflector assembly relative to the mounting brackets and the preexisting light fixture housing.

Referring now to 23-50, exemplary alternative embodiments of the present invention suitable for retrofit or replacement of preexisting ceiling light fixtures are described. In one embodiment, suitable for retrofit or replacement applications, the present invention relates to a downlight replacement light fixture 200 for efficiently distributing light emitted by a light source into an area to be illuminated that can be mounted in a preexisting light fixture housing 202, which can be, in one aspect, conventionally mounted therein a ceiling.

In one exemplary embodiment, the replacement light fixture 200 of the present invention can comprise a base housing 210 that is configured to mount to the preexisting light fixture housing. In one aspect, the base housing is configured to receive at least one light source 12 that is releasably mounted to lamp sockets 41, which are connected to portions of the base housing. In yet another aspect, the replacement light fixture can comprise a reflector assembly that is mounted to and underlies the base housing of the replacement light fixture.

In another aspect, a ballast 42 is provided that is, in at least one embodiment, connected to the base housing 210 and is in operable connection with the lamp sockets 41 to selectively energize the at least one light source 12. In this aspect, it is contemplated that the lens of the replacement light fixture is positioned with respect to a portion of the reflector to receive light emitted by the light source 12 and distribute it such that glare is further reduced. In a preferred embodiment, the lens 110 of the exemplary retrofit light reflectors receives and distributes substantially all of the light emitted by the light source. In at least one aspect, the lens 110 of the replacement fixture has the characteristics of the lens 110 described above.

Figure 23:
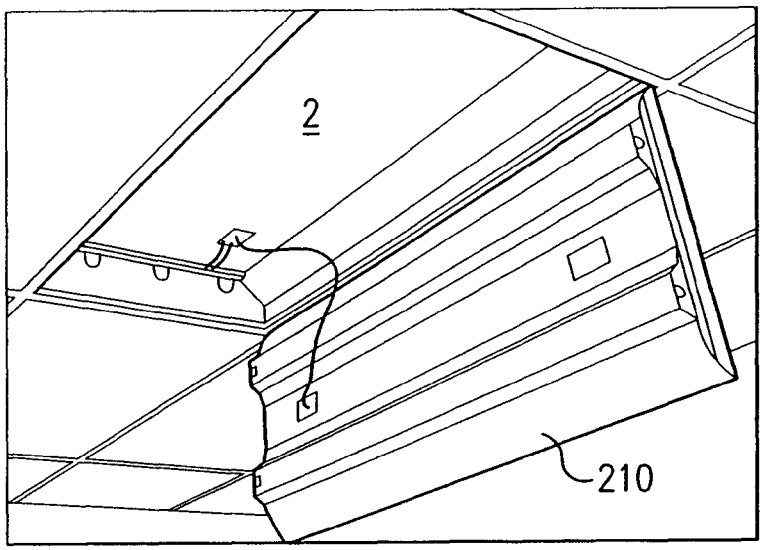
FIG. 23 is a perspective view of a first embodiment of a replacement light fixture configured to be selectively mounted to a preexisting light fixture housing that is mounted therein the ceiling, showing an integrated assembly of a base housing and reflector/lens that is pivotally mounted to a portion of the preexisting light fixture housing in an open, access position.
Figure 24:
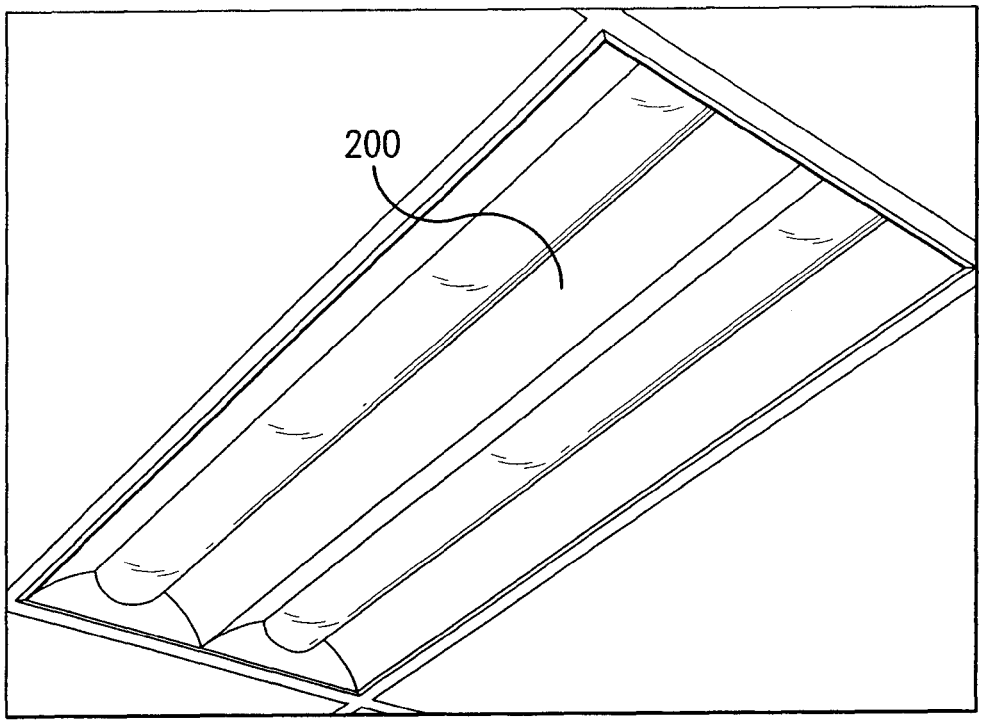
FIG. 24 is a perspective view of the replacement light fixture of FIG. 23 is the closed, mounted position.
Figure 25:
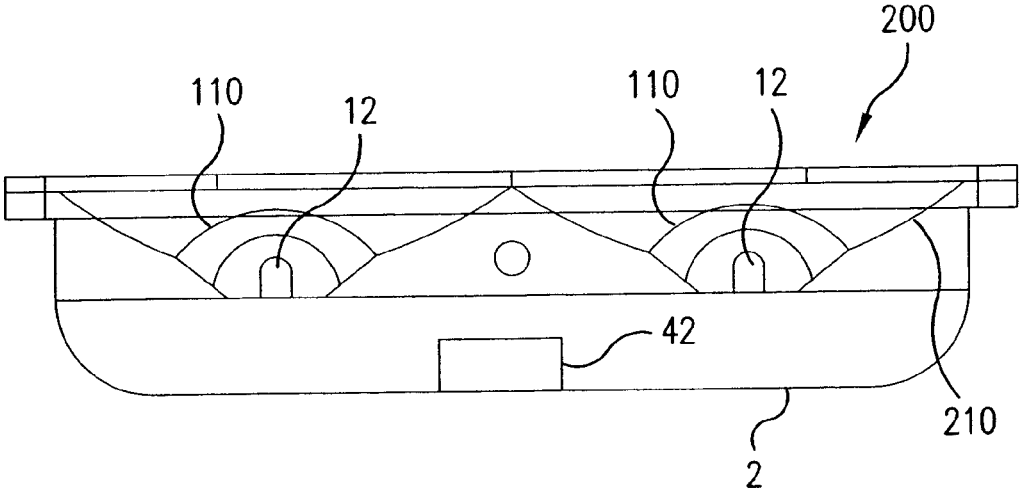
FIG. 25 is a cross-sectional view of the replacement light fixture of FIG. 23, showing a ballast for the replacement light fixture mounted to a portion of preexisting light fixture housing.

Turning to FIGS. 23 and 25, a first embodiment of an exemplary replacement light fixture 200 is illustrated. In this embodiment, the base housing 210 is coupled to the reflector assembly. After the louver, lamps, ballast and ballast cover of the preexisting light fixture are removed, the original, the preexisting lamp fixture housing 2 of the preexisting fixture remains mounted therein the ceiling. In this application, an edge of the base housing of the replacement light fixture is pivotally connected to an edge of the preexisting light fixture housing. In one example, one longitudinal edge of the base housing is pivotally connected, via a hinge, to a longitudinal edge of the preexisting light fixture housing. Alternatively, the respective end edges of the base housing and the preexisting light fixture housing are pivotally connected together. A means of selectively securing the base housing 210 of the replacement light fixture relative to the preexisting light fixture housing 2 is also provided so that the face of the replacement light fixture lies in a desired plane relative to the ceiling. In this aspect, for example, the base housing can be configured to be generally fit the peripheral size and shape of the preexisting light fixture housing. In another aspect, the base housing and reflector assembly are provided as an integral unit to be pivotally mounted therein the preexisting light fixture housing.

In one aspect of this embodiment, the replacement light fixture 200 is electrically coupled to the preexisting ballast of the preexisting light fixture. In an alternative aspect, the ballast 42 of the fixture can be mounted in an internal cavity of the fixture and is electrically coupled to the preexisting exterior power source. In yet another aspect, as shown in FIG. 25, the ballast 42 can be mounted to a portion of the exposed bottom surface of the preexisting light fixture housing. In yet another aspect, the ballast 42 can be mounted to the top surface of the housing. As one will appreciate, in the latter two aspects, the ballast 42 is readily accessible for repair by simply opening and pivoting the replacement light fixture 200 relative to the preexisting light fixture housing 202. Further, in the latter two aspects, the replacement light fixture 200 is configured to be spaced from the bottom surface of the preexisting light fixture housing a distance such that an adequate internal cavity is formed for receipt of the ballast.

Figure 26:
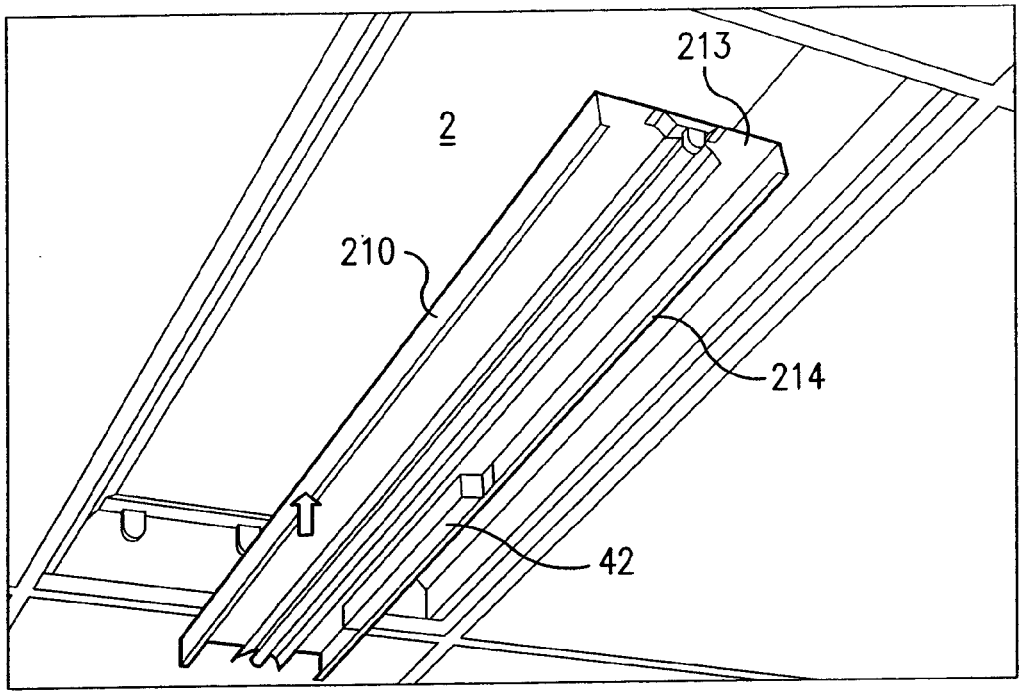
FIG. 26 is a perspective view of a second embodiment of a replacement light fixture, showing a base housing of the replacement light fixture being connected to a portion of a preexisting light fixture housing, the base housing configured to releasably mount at least one light source and a ballast operably connected to the at least one light source.
Figure 27:
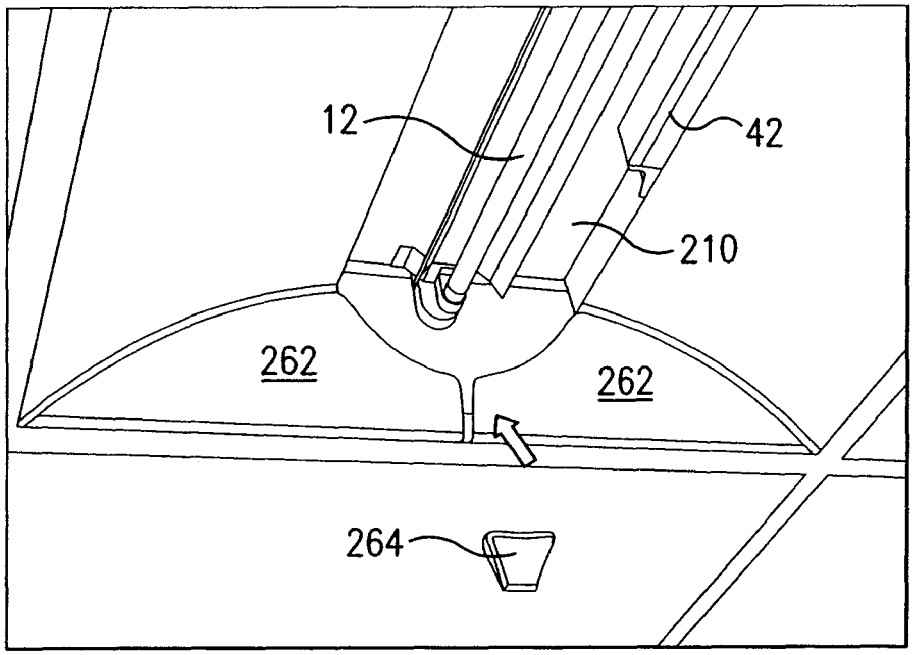
FIG. 27 is a partial perspective view of the replacement light fixture of FIG. 26, showing a lock member configured to mount to edge portions of a pair of opposed reflector members to secure the reflector members relative to the preexisting light fixture housing.
Figure 28:
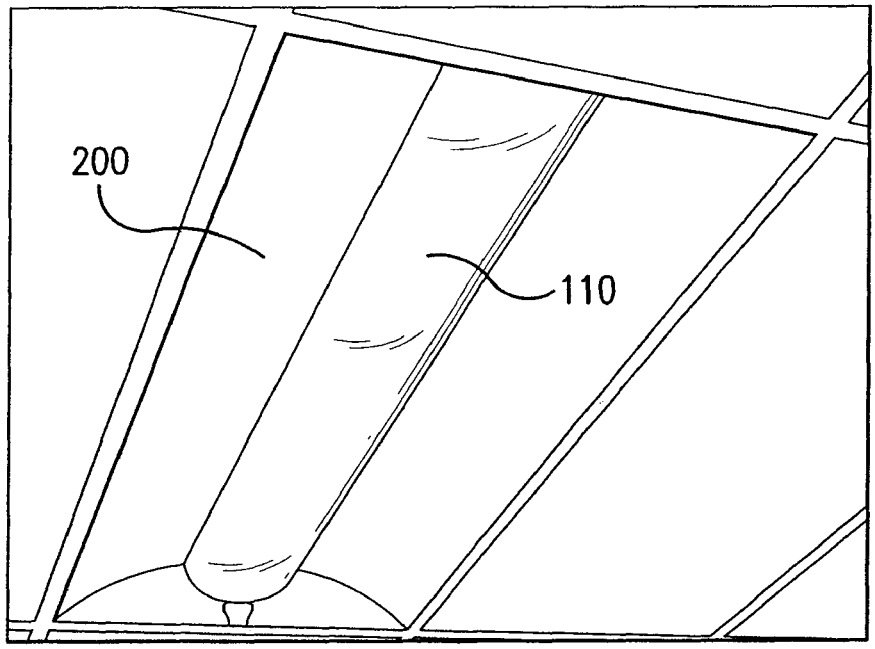
FIG. 28 is a perspective view of the replacement light fixture of FIG. 27, showing the replacement light fixture mounted to the preexisting light fixture housing in the ceiling.
Figure 29:
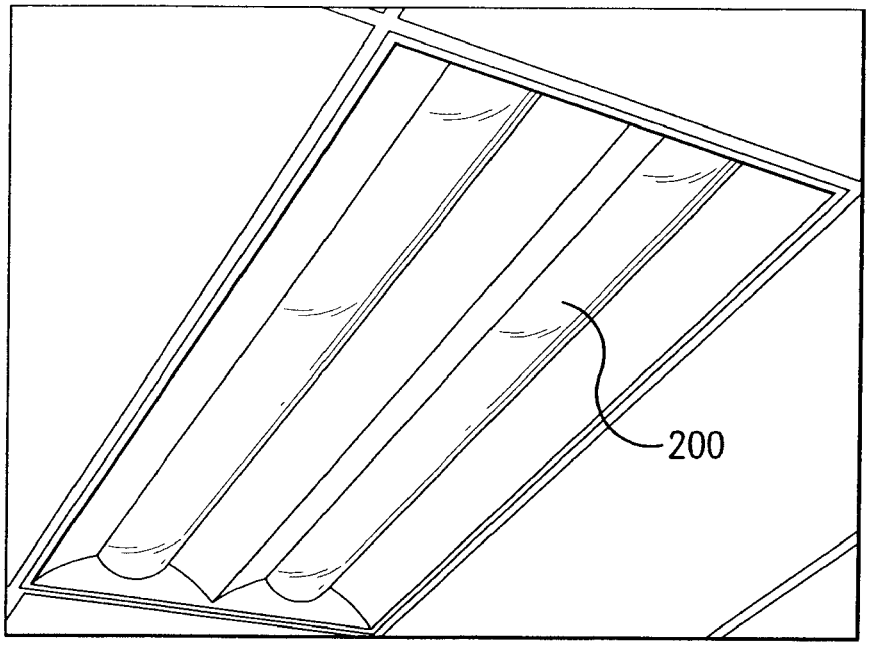
FIG. 29 is a perspective view of a third embodiment of a replacement light fixture of the present invention, showing the replacement light fixture mounted to a preexisting light fixture housing in the ceiling.
Figure 30:
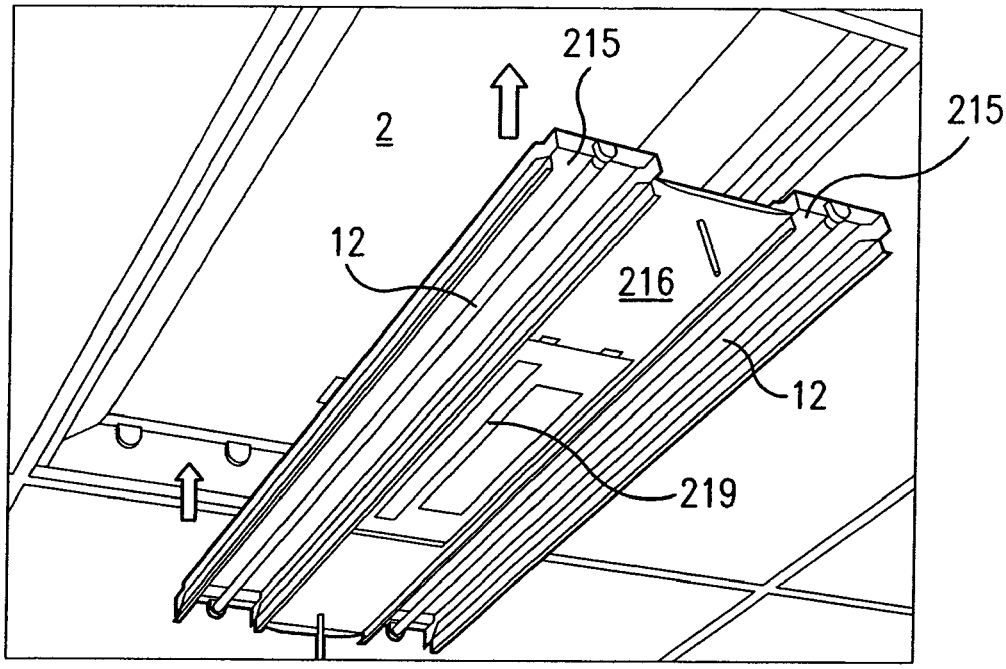
FIG. 30 is a perspective view of the replacement light fixture, showing a base housing of the light fixture being connected to a portion of the preexisting light fixture housing, the base housing configured to releasably mount at least one light source and a ballast operably connected to the at least one light source.
Figure 31:
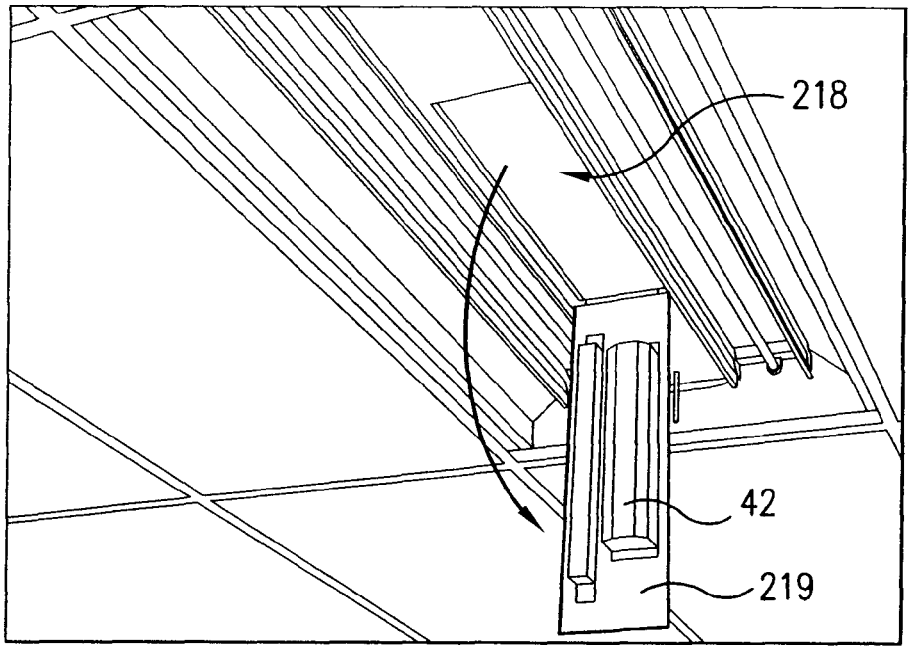
FIG. 31 is a perspective view of the replacement light fixture of FIG. 29, showing a selectively movable access door having a ballast mounted to a top side of the access door.
Figure 32:
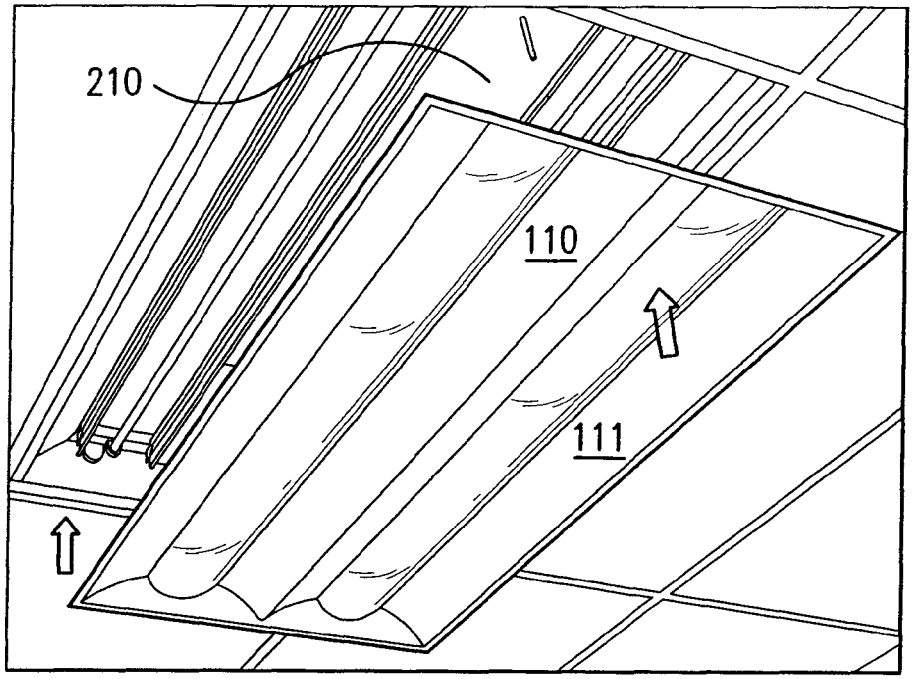
FIG. 32 is a perspective view of the replacement light fixture of FIG. 29, showing an integral reflector assembly being releasably connected to the base housing of the replacement light fixture.
Figure 33:
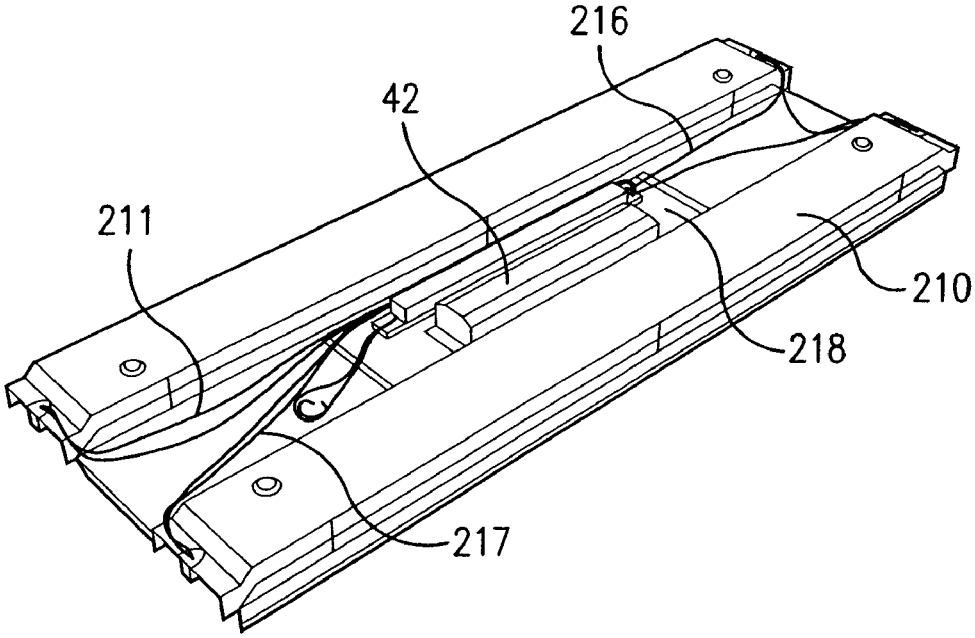
FIG. 33 is a perspective top view of the base housing of FIG. 32.
Figure 34:
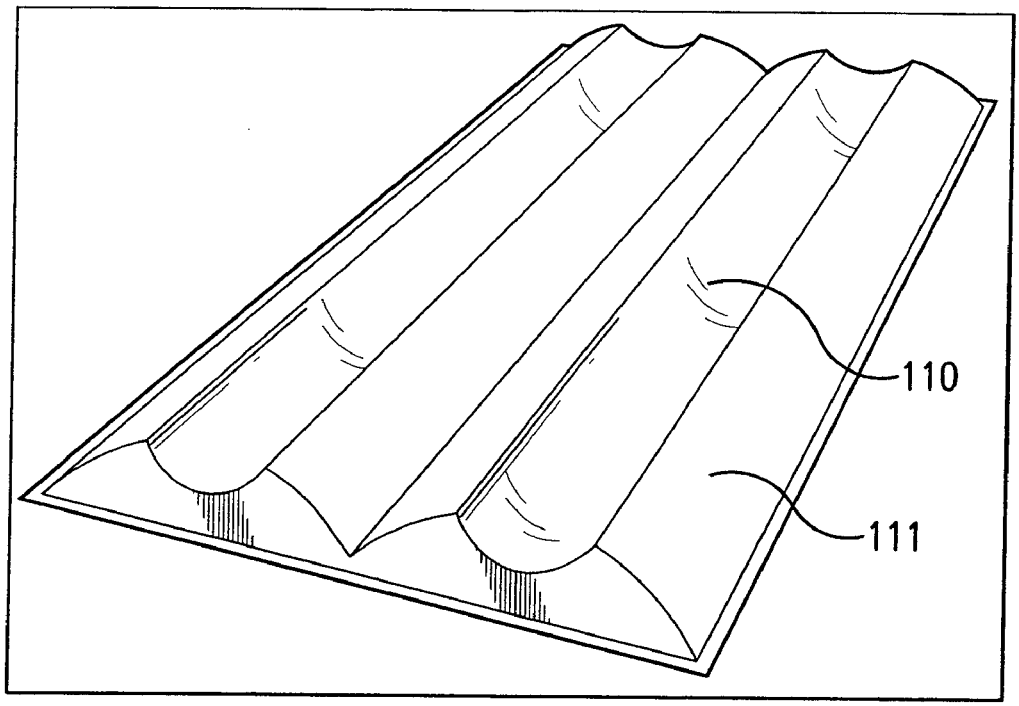
FIG. 34 is a perspective top view of the integral reflector assembly of FIG. 29.
Figure 35:
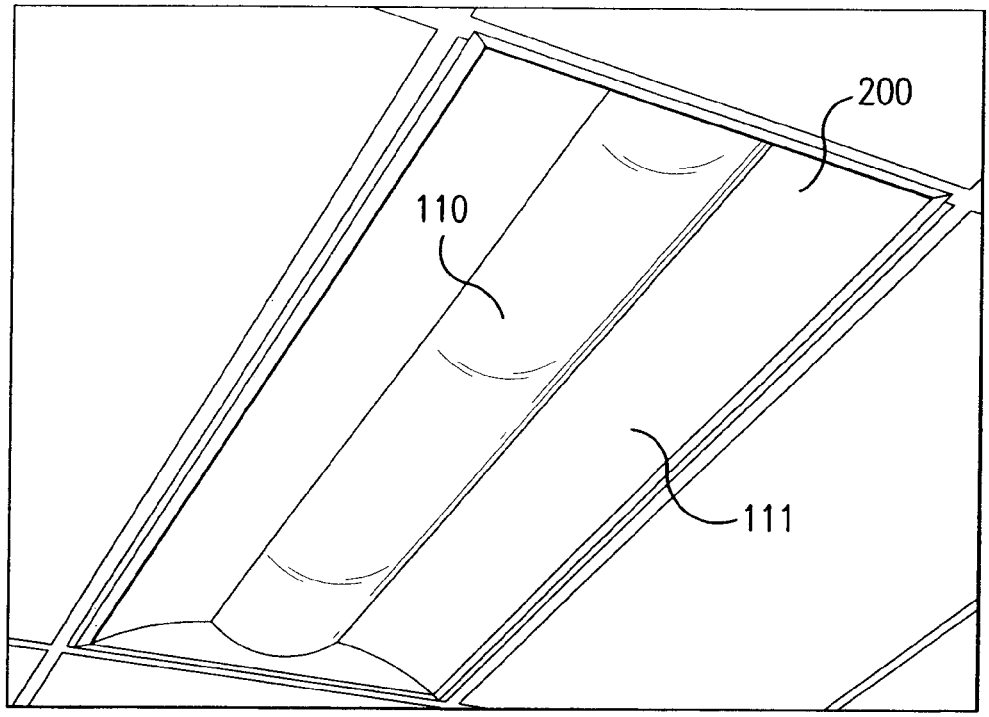
FIG. 35 is a perspective view of a fourth embodiment of a replacement light fixture of the present invention, showing the light fixture mounted to a preexisting housing in the ceiling.
Figure 36:
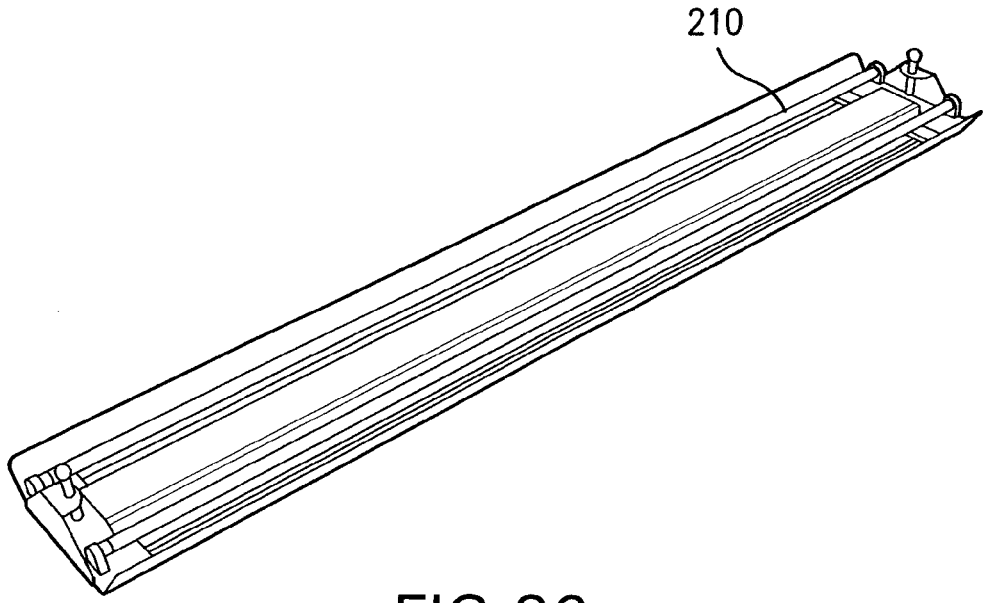
FIG. 36 is a perspective view of a base housing of the replacement light fixture, the base housing configured to releasably mount at least one light source and a ballast operably connected to the at least one light source, the base channel further showing a channel, with a selectively removable channel cover, that is configured for mounting the ballast of the light fixture.
Figure 37:
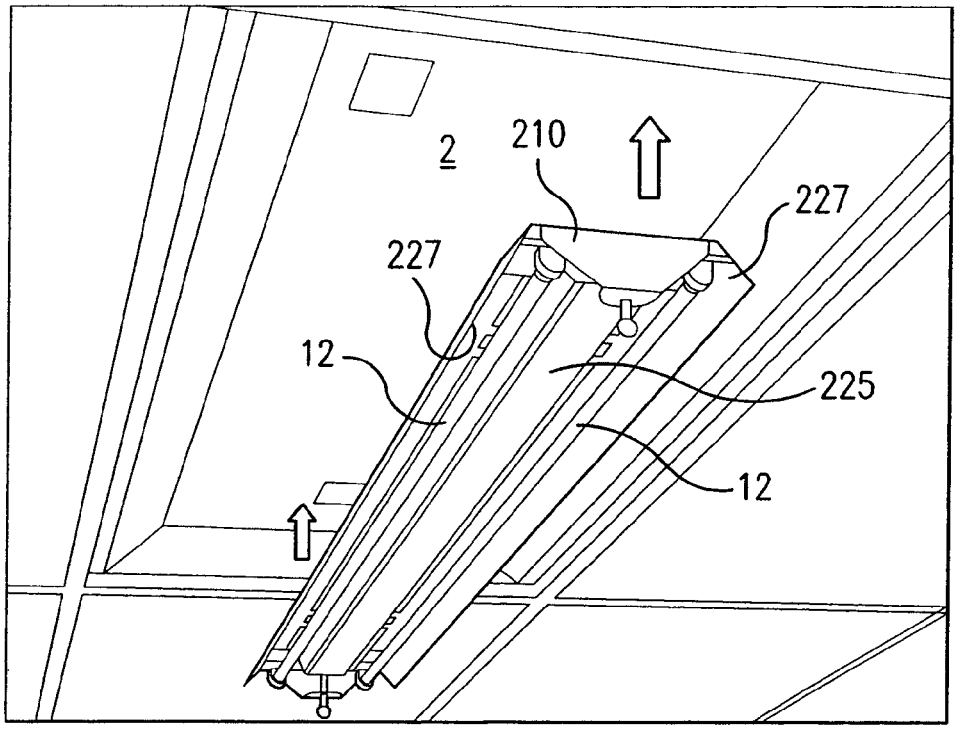
FIG. 37 is a perspective view of the base housing of FIG. 36 being mounted to the preexisting light fixture housing.
Figure 38:
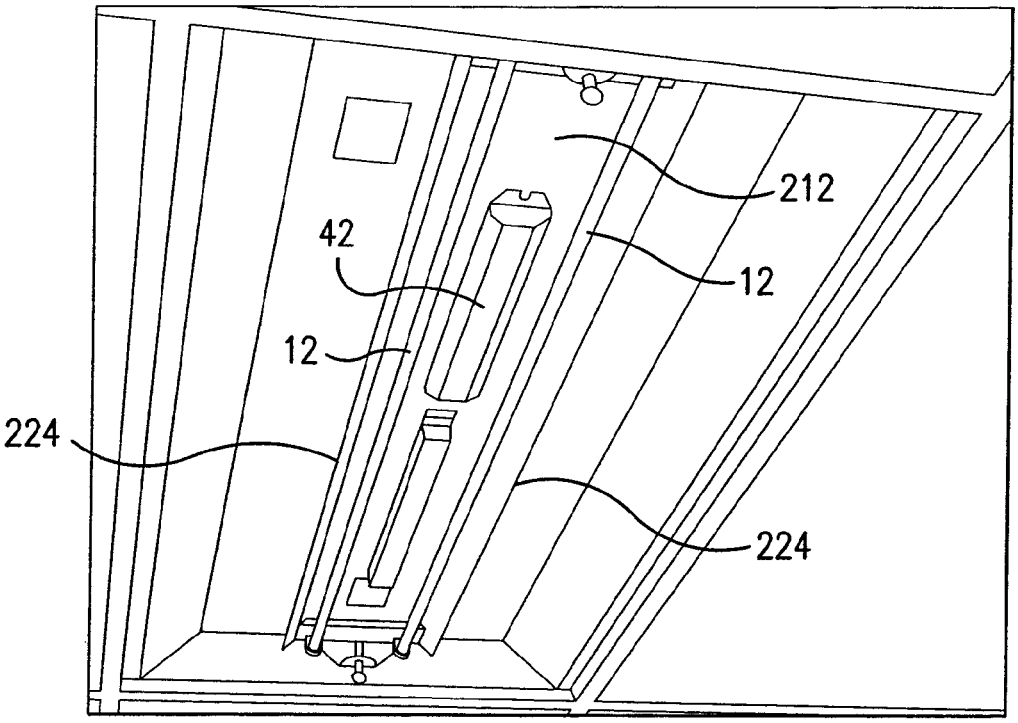
FIG. 38 is a perspective view of the base housing of FIG. 37, showing the channel cover removed and the ballast of the fixture mounted thereto portions of the base housing.
Figure 39:
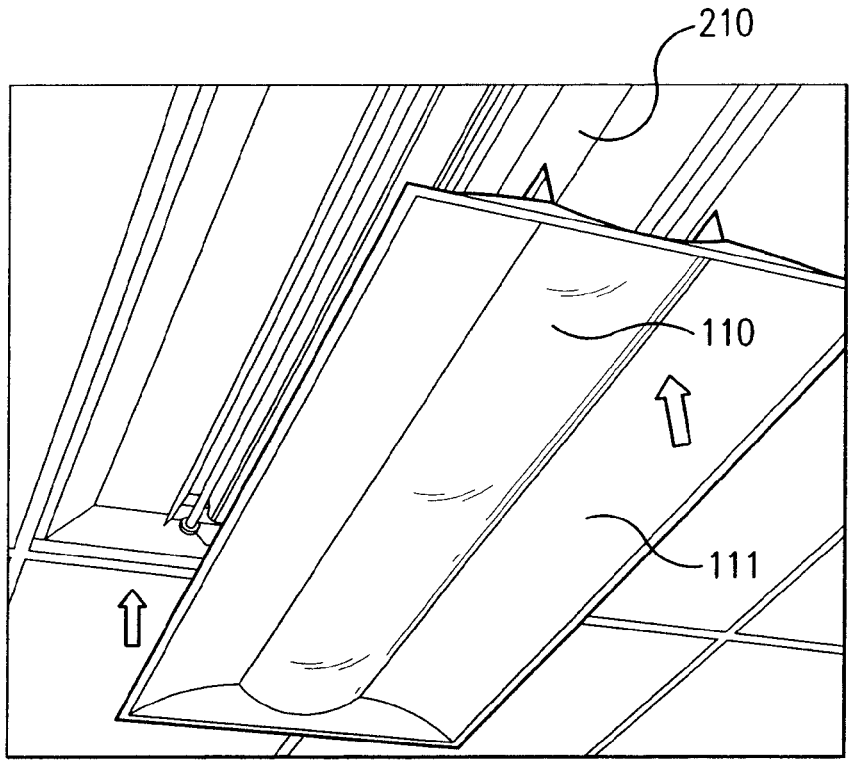
FIG. 39 is a perspective view of the replacement light fixture of FIG. 37, showing an integral reflector assembly being releasably connected to the base housing of the light fixture.
Figure 40:
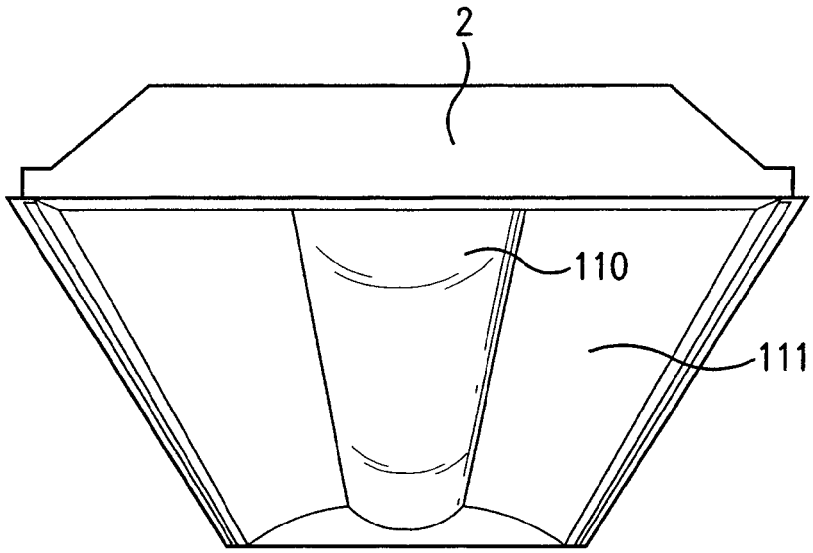
FIG. 40 is an end perspective view of the replacement light fixture of FIG. 35.

Referring now to FIGS. 26-28, a second embodiment of a replacement light fixture is illustrated. In this exemplary embodiment, the base housing 210 of the replacement light fixture is connected to a portion of a preexisting light fixture housing. In one aspect, the base housing 210 of this embodiment has a first reflector piece 213 that overlies and partially surrounds the light source. The base housing further has a pair of opposing downwardly extending longitudinal side walls 214 that are symmetrically spaced from the longitudinal axis of the base housing. In one aspect, the ballast 42 is mounted to a portion of one of the downwardly extending side walls. In a further aspect, the base housing 210 is mounted to the preexisting light fixture housing such that the base housing extends substantially along the longitudinal axis of the preexisting light fixture housing 2.

The reflector assembly of the replacement light fixture 200 of this embodiment comprises a pair of opposing, complementary reflector members 262, a pair of lock members 264, and a lens 110. In one aspect, the reflector members are mounted to respective portions of the longitudinal side walls 213 of the base housing 210 and the walls of the preexisting light fixture housing such that the reflector members 262 are positioned symmetrically with respect to the mounted base housing 210 and underlie portions of the preexisting light fixture housing. Thus, in one aspect, the reflector members 262 are installed between the top of the T-grid and the bottom of the preexisting light fixture housing. Of course, it is contemplated that the reflector members can have any desired shaped. In one example, as illustrated, the longitudinally extending walls of the reflector members are curved, at least in portion, and the "end faces" of the respective reflector members are angled with respect to the longitudinal axis of the replacement fixture. In one aspect, at least a portion of the reflector members 262 can be painted or coated with a reflective material or formed from a reflective material. The reflective material may be substantially glossy or substantially flat. In one example, the reflective material is preferably matte white to diffusely reflect incident light.

To secure the reflector members relative to the base housing 210 and the preexisting light fixture housing, each lock member 264, configured for a friction fit, is mounted to the respective opposing edges of the end faces of the reflector members, the base housing, and the preexisting light fixture housing. Finally the curved lens is mounted to the base housing 210 such that substantially all of the light generated by the light source 12 passes through the lens of the replacement fixture.

Referring now to FIGS. 29-34, a third embodiment of the replacement light fixture of the present invention is disclosed. In this embodiment, the base housing 210 defines a pair of longitudinally extending and downwardly facing troughs 215. Each trough is configured to accept a longitudinally extending light source 12. In another aspect, the pair of troughs 215 is substantially parallel to each other. In another aspect, the base housing 210 further comprises a generally planar member 216 that extends between portions of the pair of longitudinally extending troughs 215 so that the longitudinal axis of the troughs are spaced a predetermined distance apart. The base housing 210 is configured to mount to a bottom surface of the preexisting light fixture housing so that the base housing is symmetrically positioned with respect to the preexisting light fixture housing.

In one aspect, the generally planer member 216 and portions of the opposing troughs 215 define a channel 217 forming an interior cavity 218. In one example, the conventional ballast 42 is mounted to a top surface 211 of the base housing 210 such that the ballast is hidden from view of an external observer when the base housing is mounted to the preexisting light fixture housing. In one aspect, a movable cover 219 is provided on the planar member that is adapted to be opened and closed by an operator to access a ballast 42 that is disposed in the interior cavity 218 formed between the top surface 211 of the base housing 210 and portions of the preexisting light fixture housing. In another aspect, the ballast 42 can be mounted to a portion of the top side of the movable cover 219 for ready access to the ballast by an operator.

In this aspect, after the base housing is mounted to the preexisting light fixture housing and the ballast is accessed and connected to the preexisting power leads, the reflector assembly is mounted to the base housing 210 such that it substantially underlies the base housing and fully encloses the fixture. In this aspect, it is contemplated that the reflector portion 111 and lens 110 can be, in one example, formed integral to each other or can, in another example, be separate pieces that can be mounted with respect to each other and the base housing 210. In one aspect, the reflector portion 111 of the reflector assembly is substantially opaque.

In one aspect, the longitudinally extending sides 220 of the troughs 215 are mounted to the base housing by means that allow the sides 220 of the trough to be self-adjusting in height. In one exemplary aspect, the each side can have a plurality of vertically oriented slots defined therein. These slots are in operable communication with complementary bias members that extend from respective portions of the base housing 210. Thus, the replacement fixture 200 of the present invention can be used in preexisting light fixture housing of varying depth as the adjustable sides of the troughs of the base housing articulate so that they are in contact with or are adjacent to top portions of the reflector assembly.

Referring now to FIGS. 35-42, a fourth embodiment of a replacement light fixture of the present invention is illustrated. In this embodiment, the base housing 210 has a pair of longitudinally extending and downwardly facing side edges 224. In one aspect, the conventional ballast 42 is mounted to a bottom surface 212 of the base housing. A formed channel cover 225 is provided that is configured to mount between the light sources 12 such that the ballast is hidden from view of an external observer when the channel cover 225 is attached to the base housing 210. In another aspect, the respecting side edges and the sides of the formed channel cover defines a pair of longitudinally extending and downwardly facing troughs 227. As one will appreciate, each trough is configured to accept one longitudinally extending light source 12. In another aspect, the pair of troughs is substantially parallel to each other. In another aspect, the longitudinal axes of the troughs 227 are spaced a predetermined distance apart. The base housing 210 is configured to mount to a bottom surface of the preexisting light fixture housing so that the base housing is symmetrically positioned with respect to the preexisting light fixture housing.

Figure 41:
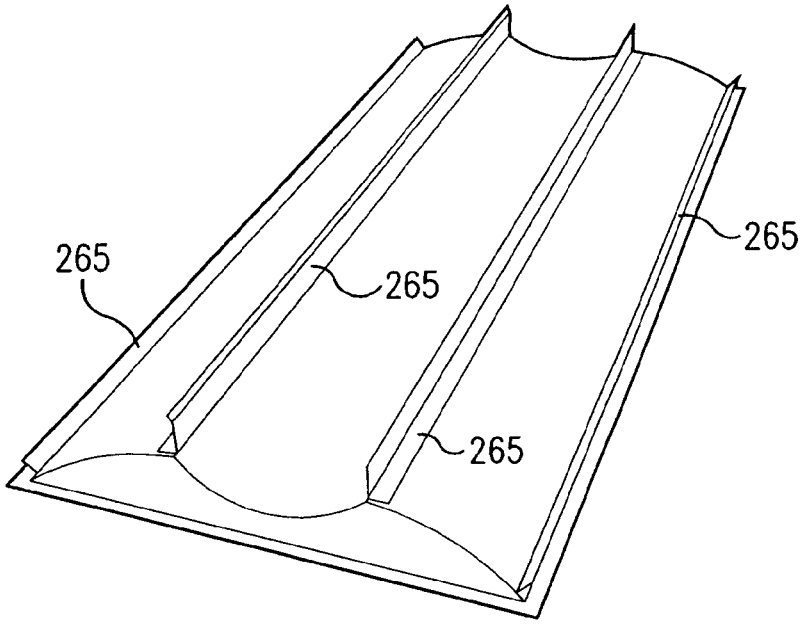
FIG. 41 is a perspective top view of the integral reflector assembly of FIG. 35.
Figure 42:
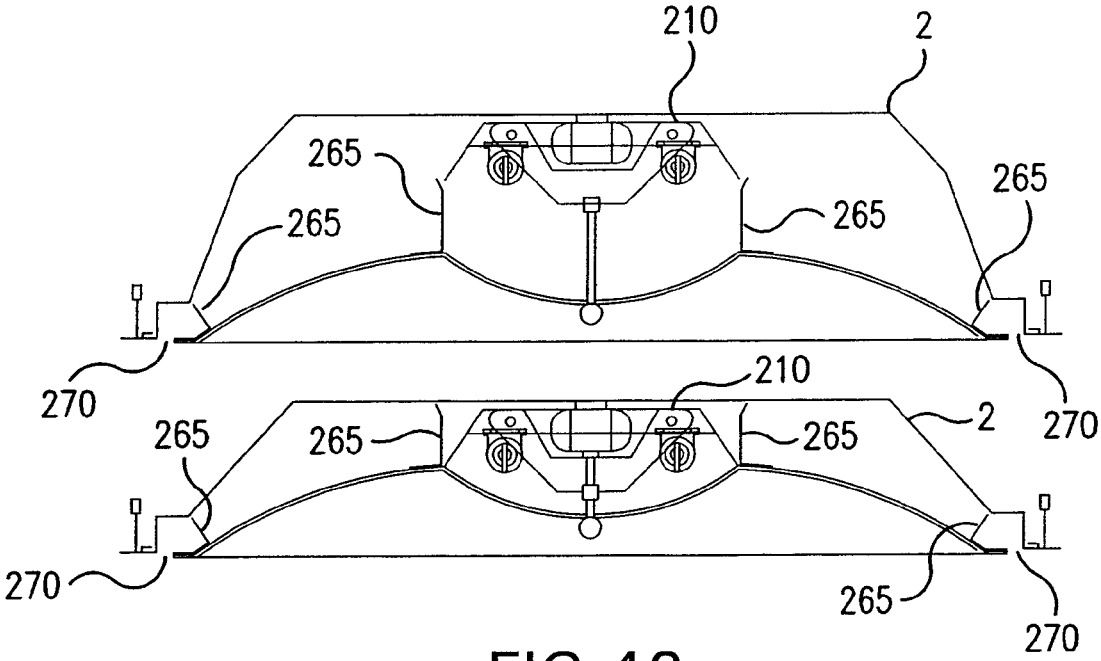
FIG. 42 are exemplary cross-sectional views of the replacement light fixture of FIG. 35, showing exemplary ranges of adjustability of the reflector assembly relative to the overlying base housing.
Figure 43:
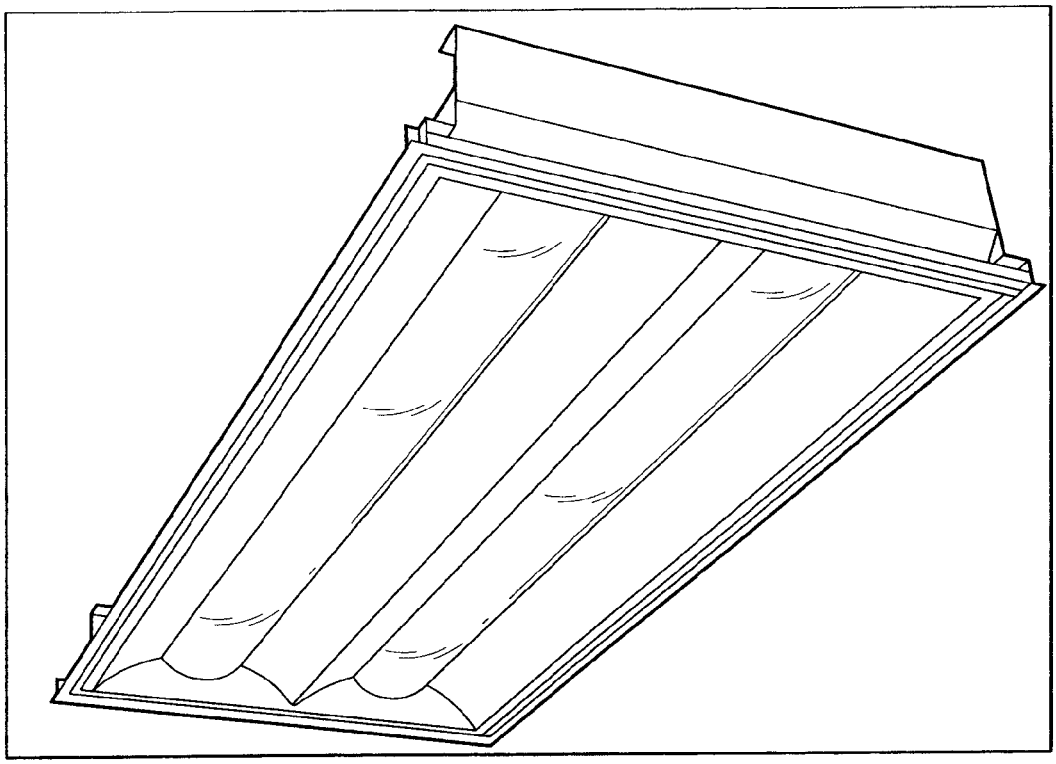
FIG. 43 is a perspective view of a fifth embodiment of a replacement light fixture of the present invention, showing the light fixture mounted to a preexisting light fixture housing in the ceiling.
Figure 44:
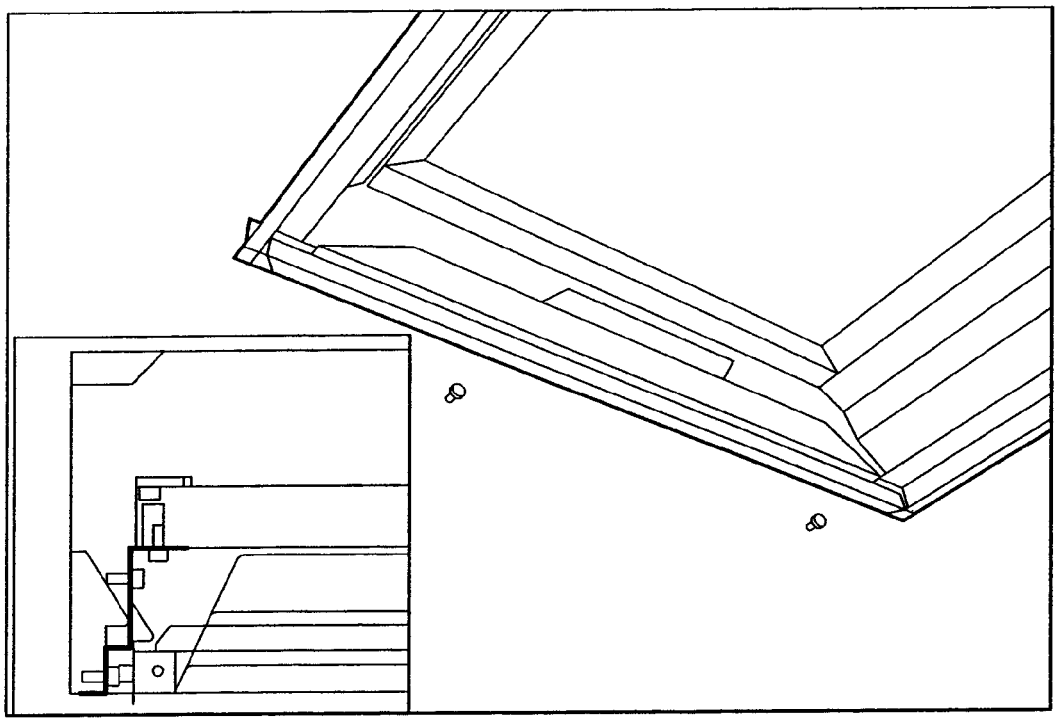
FIG. 44 are perspective and cross-sectional views of a bracket for mounting the replacement light fixture connected to end portions of the preexisting light fixture housing.
Figure 45:
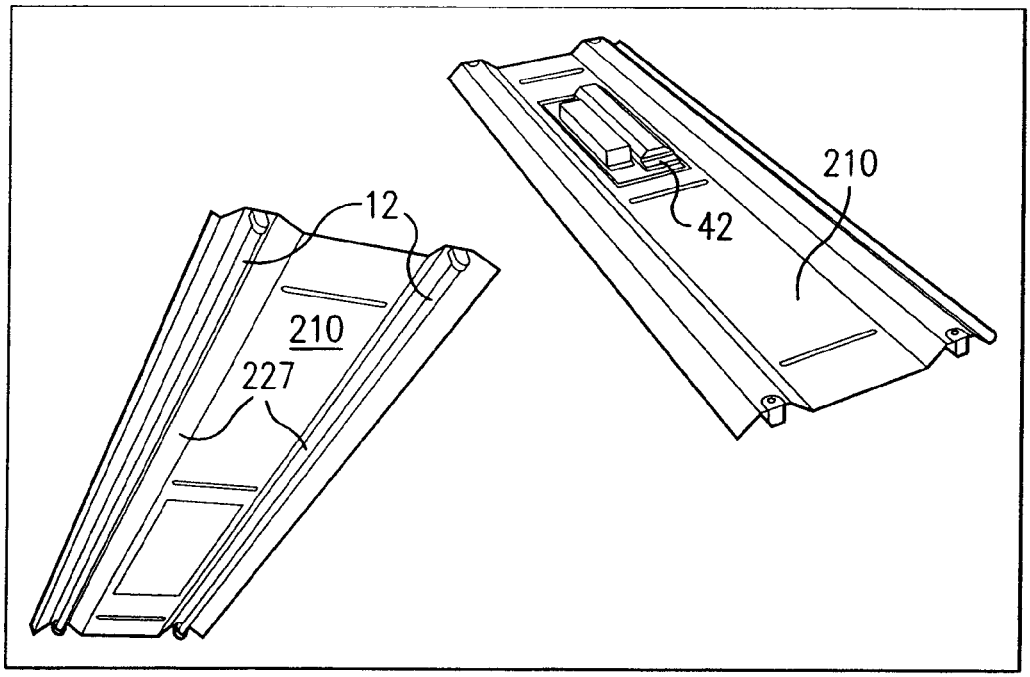
FIG. 45 are bottom and top perspective views of a light engine of the replacement light fixture that is configured to mount to the brackets of FIG. 44, showing the lamps and the ballast of the light engine.
Figure 46:
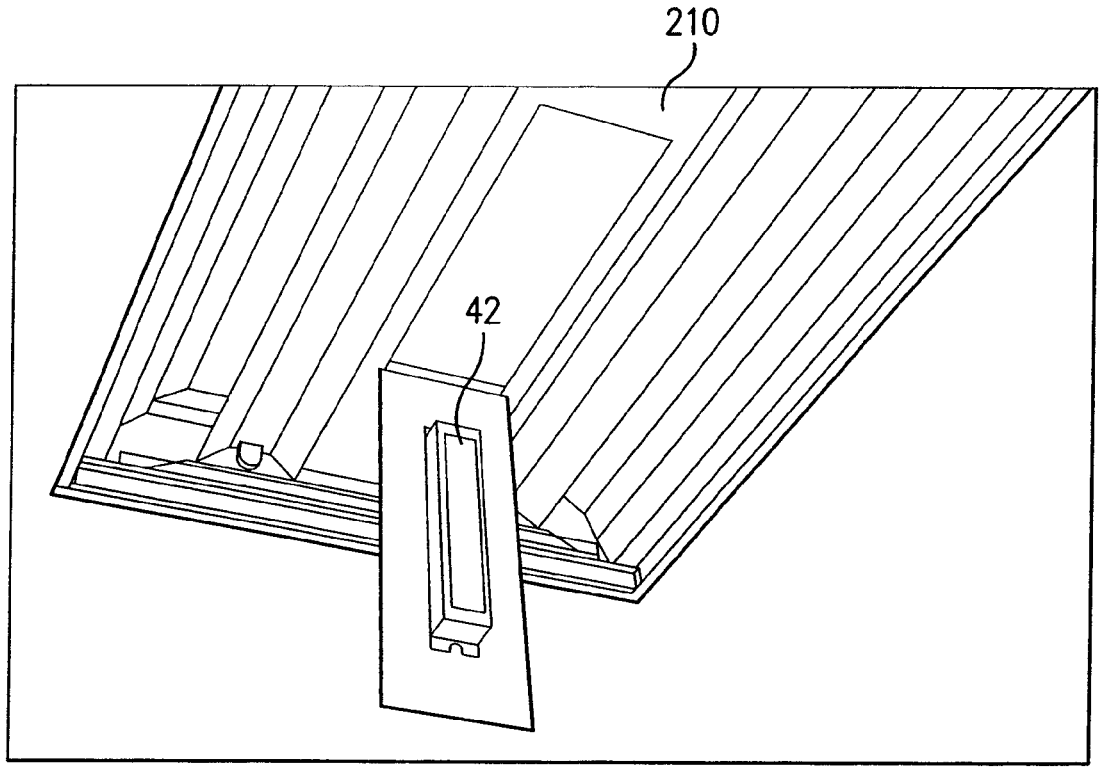
FIG. 46 is a perspective view of a hinged ballast door that allows access to the ballast of the light engine and allows for access to power lines positioned on the top of the light fixture.
Figure 47:
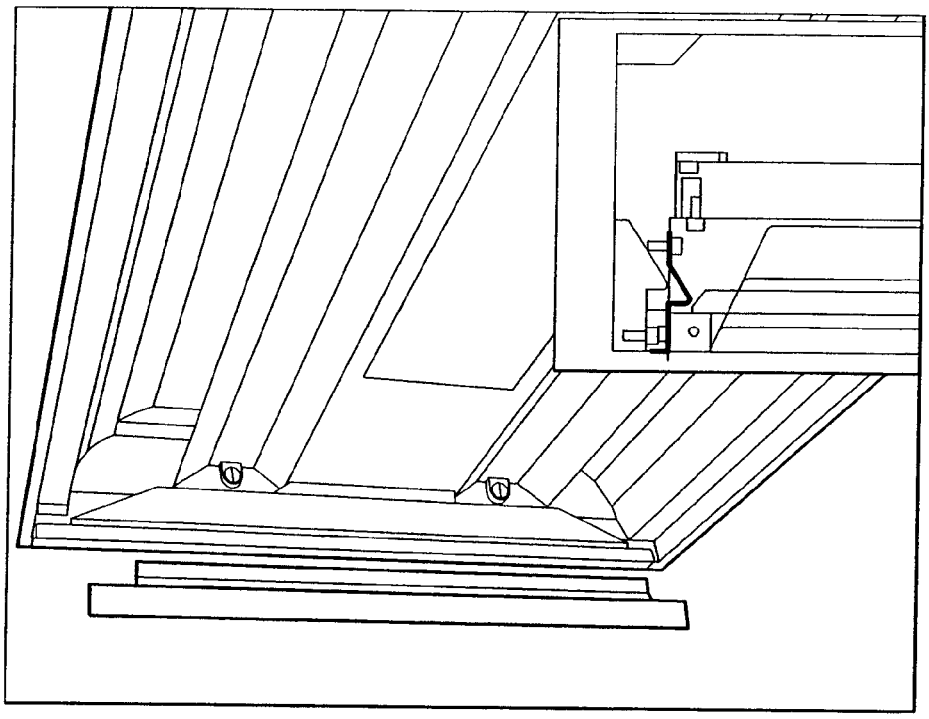
FIG. 47 are perspective and cross-sectional views of a hinge plate/light trap that is configured to be mounted to a portion of the bracket of FIG. 44.
Figure 48:
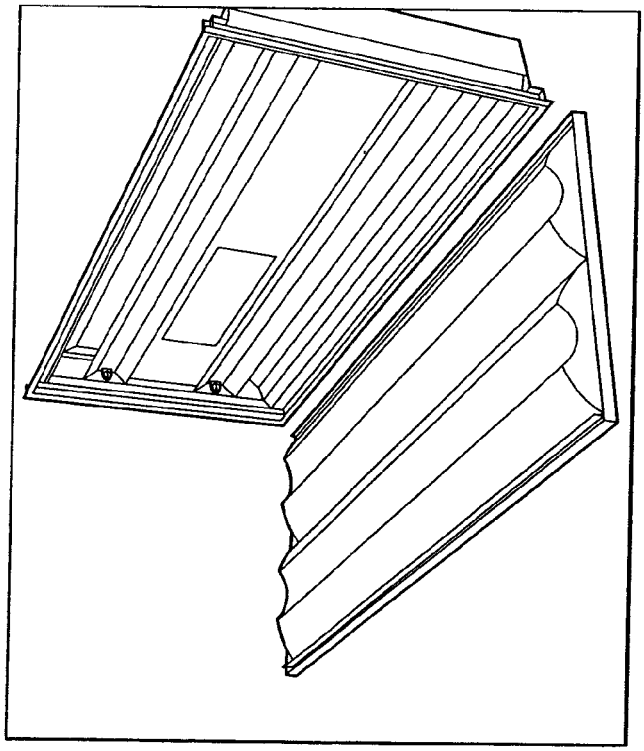
FIG. 48 is a perspective view of the replacement light fixture of FIG. 44 showing the light sources and the door assembly being installed.
Figure 49:
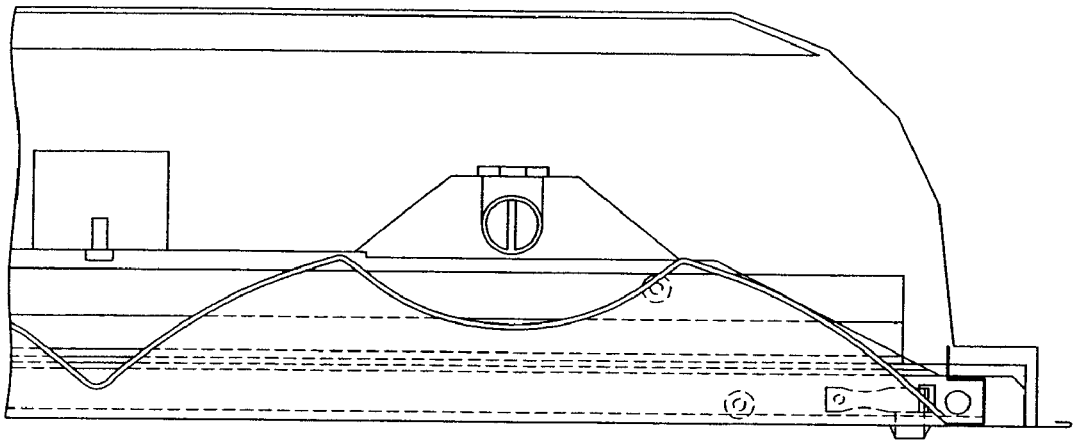
FIG. 49 is a partial end cross-sectional view of the replacement light fixture of FIG. 44.
Figure 50:
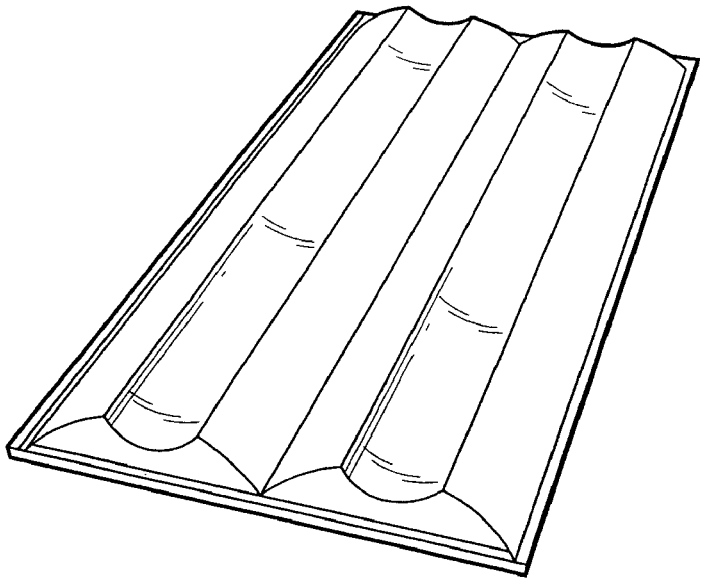
FIG. 50 is a top perspective view of an exemplary door assembly.

In this aspect, after the base housing 210 is mounted to the preexisting light fixture housing and the ballast is accessed and connected to the preexisting power leads, the reflector assembly is mounted to the base housing such that it substantially underlies the base housing 210 and fully encloses the fixture. In this aspect, it is contemplated that the reflector portion and lens of the reflector assembly can be, in one example, formed integral to each other or can, in another example, be separate pieces that can be mounted with respect to each other and the base housing. In one aspect, the reflector portion of the reflector assembly is substantially opaque. Referring to FIG. 41, the reflector assembly can further comprise at least one longitudinally extending and upwardly extending light bar members 265 that cooperate with portions of the base housing 210 to direct the light generated by the light sources. Thus, as shown in FIG. 42, in one aspect, the light bar members 265 allow for the use of the replacement fixture of the present invention in preexisting light fixture housing of varying depth as the light bar helps to direct the generated light through the lens 250 of the reflector assembly.

In a further aspect, a reveal 270 can be provided between at least one edge of the replacement light fixture 200 and the preexisting light fixture housing 202 such that airflow is allowed when the replacement light fixture is installed as a replacement for an air handling light fixture. In yet another aspect, the reflector assembly can be configured to overlap the T-grid at the respective ends of the replacement light fixture 200 only.

Referring now to FIGS. 43-50, a fifth embodiment of a replacement light fixture of the present invention is illustrated. In this embodiment, the base housing 210 comprises a light engine that defines a pair of longitudinally extending and downwardly facing troughs. As one will appreciate, each trough is configured to accept one longitudinally extending light source 12. In another aspect, the pair of troughs is substantially parallel to each other. In another aspect, the longitudinal axes of the troughs 227 are spaced a predetermined distance apart. In another aspect, the troughs are positioned on the opposing edge portions of the longitudinal edges of the housing.

In a further aspect, the light engine defines a channel therebetween the troughs on the top side of the base housing. In one aspect, a ballast door is configured to allow for hinged access to the channel from the bottom side of the housing. That is, the ballast door can be readily and selectively opened from the bottom side of the housing. In this aspect, the ballast/inverter of the light engine can be mounted onto the top surface of the channel and access via the opening of the ballast door. It is also contemplated that the ballast/inverter could be mounted to the top surface of the ballast door to further simplify access to the ballast of the light engine and the power source/lines that are positioned above the housing when it is positioned therein the preexisting light fixture housing. It is contemplated that a ground strap can be electrically bonded to the swing down ballast tray.

One will appreciate that the design of the light engine precludes having to individually install socket brackets for new lamps. Further, the light engine design promotes high density stacking. It is contemplated that a narrow light engine design can be used to allow the use of T8 lamps with the exemplified replacement light fixture. It is contemplated that the replacement light fixture can be installed onto a preexisting SP8 door frame.

This embodiment of the replacement light fixture further comprises a pair of brackets and a pair of hinge plates. In one aspect, each bracket is configured to be mounted to a portion of the longitudinal end walls of the preexisting light fixture housing. Each bracket defines a mounting flange that is positioned within the interior of the preexisting light fixture housing when the bracket is mounted. Further, the bracket is configured to support or hold itself in place until it can be secured into position. In operation, the bottom surfaces of the longitudinal ends of the base housing of the light engine are configured to sit on the opposed mounting flanges. Thus, the brackets act to support the light housing until it can be securely fastened. In one exemplary aspect, the ends of the base housing are connected to the mounting flanges of the bracket by mechanical means, such as, without limitation, screws, bolts, self-drilling screws, and the like.

In another aspect, each hinge plate is configured to be mounted to a face portion of a bracket. Each hinge plate has a male ridge that extends the width of the plate such that, when installed onto the bracket, the male ridge extends inwardly into the interior of the fixture. This subsequently acts as a light trap for the door assembly of the replacement light fixture. In one exemplary aspect, the hinge plate is connected to the bracket by mechanical means, such as, without limitation, screws, bolts, self-drilling screws, and the like. One skilled in the art would appreciate that the metallic mechanical means act to electrically couple the components of the light fixture. In a further aspect, each hinge plate defines at least one opening that is configured to complementarily accept a hinge and latching means of the door assembly of the replacement light fixture.

The door assembly comprises a metal, such as steel for example, perimeter frame. Portions of the door assembly form hinge and latching means, such as, for example hinge bias members, that complementarily and selectively couple with the hinge and latching means, such as, for example cam latches. In one aspect, the door assembly comprises a metallic reflector assembly with snap in polymeric lenses that can be formed from acrylic for example. In another aspect, the door assemblies comprising an integrated metallic reflector/light engine with snap in polymeric lenses. Optionally, a one piece polymeric reflector with co-molded lenses can be used. In this aspect, it is contemplated that the lenses can be substantially light transmissive and the reflector portions can be opaque. In a further aspect, the co-molded lens can include micro optic patters that negate the need for the use of a diffusing overlay.

As outlined above, it is contemplated that the reflector and lens can be, in one example, formed integral to each other or can, in another example, be separate pieces that can be mounted with respect to each other and the base housing. In one aspect, the reflector portion of the reflector assembly is substantially opaque. In another aspect, the reflectors can have, if desired, a corrugated surface.

In a further aspect, a reveal can be provided between at least one edge of the replacement light fixture and the preexisting light fixture housing such that airflow is allowed when the replacement light fixture is installed as a replacement for an air handling light fixture. In yet another aspect, the reflector assembly can be configured to overlap the T-grid at the respective ends of the replacement light fixture only.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

What is claimed is:

1. An assembly for use with a preexisting recessed light fixture housing, the preexisting recessed light fixture housing having a pair of spaced and opposed end walls, each end wall having bottom edge portions that are positioned in the ceiling plan, and a pair of spaced and opposed side walls extending therebetween the end walls, the assembly comprising:

a base assembly comprising a longitudinally extending base member;

a first mounting bracket and a second mounting bracket, each mounting bracket having a lower portion defining a channel that is selectively mountable to the bottom edge portion of one of the respective ends of the light fixture housing, wherein each mounting bracket has an upper portion defining an upper shoulder that is spaced from the channel a predetermined distance, wherein each mounting bracket is configured to be substantially received within the housing and is configured to be self-centering relative to the respective end walls of the light fixture housing;

means for hingeably connecting the base assembly to the first mounting bracket such that the base assembly is movable between an installation position and an operating position; and an elongate reflector assembly detachably coupled to portions of the first and second mounting brackets and extending therebetween substantially parallel to the ceiling plane.

2. The assembly of claim 1, wherein the reflector assembly comprises at least one elongated lens and wherein at least a portion of the reflector assemblyis positioned at or above the ceiling plane.

3. The assembly of claim 2, further comprising means for selectively pivotably securing the reflector assembly to the portion of the first and second mounting brackets.

4. The assembly of claim 2, wherein the reflector assembly controls high angle glare in the transverse direction by blocking high angle rays from the lens, and wherein the lens controls high angle glare in the longitudinal direction optically.

5. The assembly of claim 1, wherein each mounting bracket is configured to be self-centering on the housing end walls with respect to the side walls of the preexisting recessed light fixture housing.

6. The assembly of claim 2, wherein substantially all of the light emitted by the light fixture passes through the at least one lens.

7. The assembly of claim 1, further comprising a powered light source disposed within the housing for emitting light, the reflector assembly being configured to shape the distribution of light emitted from the light fixture.

8. The assembly of claim 1, further comprising a powered light source disposed within the housing for emitting light, the reflector assembly being configured to reduce high angle glare of the light emitted from the light source.

9. The assembly of claim 1, further comprising a powered light source disposed within the housing for emitting light, the reflector assembly being configured to visibly obfuscate the light source at a high angle degree of incidence with respect to the light fixture housing.

10. A retrofit assembly for use with a preexisting recessed light fixture housing, the preexisting recessed housing having a pair of spaced and opposed end walls with a pair of spaced and opposed side walls extending between the end walls, the retrofit assembly comprising:

a longitudinally extending base assembly;

a first mounting bracket and a second mounting bracket, wherein each mounting bracket being configured to be substantially received within the housing, wherein each mounting bracket has a lower portion defining a channel that is selectively mountable to the bottom edge portion of one of the respective ends of the light fixture housing, and wherein each mounting bracket is configured to be self-centering on a respective end wall and relative to the respective side walls;

means for hingeably connecting the base assembly to the first mounting bracket such that the base assembly is movable between an installation position and an operating position; and an elongate reflector assembly extending between and detachably mounted to the first and second mounting brackets.

11. The retrofit assembly of claim 10, further comprising a powered light source disposed within the housing for emitting light, the reflector assembly being configured to shape the distribution of light emitted from the light fixture.

12. The retrofit assembly of claim 10, further comprising a powered light source disposed within the housing for emitting light, the reflector assembly being configured to reduce high angle glare of the light emitted from the light source.

13. The retrofit assembly of claim 10, wherein the reflector assembly comprises at least one elongated lens and wherein at least a portion of the reflector assembly is positioned at or above the ceiling plane, wherein the reflector assembly controls high angle glare in the transverse direction by blocking high angle rays from the lens, and wherein the lens controls high angle glare in the longitudinal direction optically.

14. The retrofit assembly of claim 10, further comprising at least one lamp socket mounted on the base member.

15. The retrofit assembly of claim 14, further comprising at least one lamp received within the at least one socket.

16. The retrofit assembly of claim 14, the at least one lamp socket comprising at least one pair of spaced lamp sockets sized and shaped to receive a liner light source extending therebetween.

17. The retrofit assembly of claim 16, the at least one lamp being powered and emitting light, the reflector assembly being sized and shaped to reduce high angle glare of the light emitted from the at least one lamp.

18. A retrofit assembly for a preexisting recessed light fixture housing mounted in a ceiling plane, the light fixture housing having opposed end walls, each end wall having a bottom edge portion that lies within the ceiling plane, comprising:

a. a longitudinally extending base member;

b. a first mounting bracket and an opposed second mounting bracket, each mounting bracket being substantially self-centering and selectively mountable to the respective end walls of the preexisting recessed light fixture housing, wherein each mounting bracket has a lower portion defining a channel that is selectively mountable to the bottom edge portion of one of the respective ends of the light fixture housing;

c. a means for hingeably connecting the base member to the mounting brackets such that the base assembly is movable between an installation position, in which the base member is suspended from the first mounting bracket, and an operating position, and an operating position, in which the base member is positioned substantially parallel to the ceiling plane and is selectively secured to at least a portion of the respective upper shoulder of the first and second mounting brackets; and d. a longitudinally extending reflector assembly detachably secured to the first and the second mounting brackets and positionable substantially parallel to the ceiling plane.

19. The retrofit assembly of claim 18, wherein the reflector assembly comprises at least one elongated lens and wherein at least a portion of the reflector assembly is positioned at or above the ceiling plane, wherein the reflector assembly controls high angle glare in the transverse direction by blocking high angle rays from the lens, and wherein the lens controls high angle glare in the longitudinal direction optically.

20. A retrofit light fixture for use with a preexisting recessed light fixture housing having opposed end walls, each end wall having a bottom edge portion that is positioned within a ceiling plane, comprising:

a first mounting bracket and an opposed second mounting bracket, each mounting bracket having a lower portion defining a channel that is selectively mountable to the bottom edge portion of a respective end wall of the housing such that a bottom surface of the channel is positioned substantially within the ceiling plane, each mounting bracket also being sized and shaped to be self-centering on the respective end walls of the light fixture housing a base assembly comprising a longitudinally extending base member having a proximal edge and an opposed distal edge;

a means for hingeably connecting the base member to the mounting brackets, the base assembly having a first installation position in which the base member is suspended from the first mounting bracket and a second operating position in which the base member is selectively secured to the second mounting bracket; and a longitudinally extending reflector assembly selectively secured to the first and second mounting brackets.

* * * * *